US010289035B2

(12) United States Patent
Kim et al.

(10) Patent No.: US 10,289,035 B2
(45) Date of Patent: May 14, 2019

(54) IMAGE FORMING DEVICE AND CONTROL METHOD FOR GENERATING A PLURALITY OF TONER IMAGES

(71) Applicant: S-PRINTING SOLUTION CO., LTD., Suwon-si, Gyeonggi-do (KR)

(72) Inventors: Jongchoon Kim, Suwon-si (KR); Uichoon Lee, Suwon-si (KR); Jungwoo Son, Suwon-si (KR); Byoungil Lee, Suwon-si (KR)

(73) Assignee: S-Printing Solution Co., Ltd., Suwon-si (KR)

( * ) Notice: Subject to any disclaimer, the term of this patent is extended or adjusted under 35 U.S.C. 154(b) by 0 days.

(21) Appl. No.: 15/775,763

(22) PCT Filed: Oct. 26, 2016

(86) PCT No.: PCT/KR2016/012087
§ 371 (c)(1),
(2) Date: May 11, 2018

(87) PCT Pub. No.: WO2017/086619
PCT Pub. Date: May 26, 2017

(65) Prior Publication Data

US 2018/0348674 A1 Dec. 6, 2018

(30) Foreign Application Priority Data

Nov. 16, 2015 (KR) ..... 10-2015-0160689

(51) Int. Cl.
*G03G 15/00* (2006.01)
*G03G 15/16* (2006.01)
(Continued)

(52) U.S. Cl.
CPC ..... *G03G 15/1615* (2013.01); *G03G 13/01* (2013.01); *G03G 13/05* (2013.01);
(Continued)

(58) Field of Classification Search
CPC ..... G03G 15/5041; G03G 15/5054; G03G 15/5058
(Continued)

(56) References Cited

U.S. PATENT DOCUMENTS 8,867,973 B2 * 10/2014 Masui ..... G03G 15/5058 399/301
9,020,406 B2 * 4/2015 Igarashi et al. .... G03G 15/5058 399/301

FOREIGN PATENT DOCUMENTS

JP 2001-194851 A 7/2001
JP 2012-061695 A 3/2012
(Continued)

*Primary Examiner* — William J Royer
(74) *Attorney, Agent, or Firm* — Jefferson IP Law, LLP

(57) ABSTRACT

An image forming device is provided. The image forming device may include a transfer belt to move in a preset direction, a plurality of image generators to respectively generate a toner image on the transfer belt, and a controller to output an image generation signal to each of the plurality of image generators such that the plurality of image generators respectively generate a toner image. A plurality of toner images generated using the plurality of image generators are arranged on the transfer belt in parallel to each other, and an arrangement order of the plurality of toner images is identical to an arrangement order of the plurality of image generators.

14 Claims, 19 Drawing Sheets

(51) Int. Cl.

| | |
|---|---|
| ***G03G 13/06*** | (2006.01) |
| ***G03G 13/14*** | (2006.01) |
| ***G03G 15/01*** | (2006.01) |
| ***G03G 15/05*** | (2006.01) |
| ***G03G 15/08*** | (2006.01) |
| ***G03G 13/01*** | (2006.01) |
| ***G03G 13/05*** | (2006.01) |

(52) U.S. Cl.
CPC ..... *G03G 13/06* (2013.01); *G03G 13/14* (2013.01); *G03G 15/01* (2013.01); *G03G 15/05* (2013.01); *G03G 15/08* (2013.01)

(58) Field of Classification Search
USPC ..... 399/49, 72, 301
See application file for complete search history.

(56) References Cited

FOREIGN PATENT DOCUMENTS

| | | | |
|---|---|---|---|
| JP | 2014-115339 | A | 6/2014 |
| KR | 10-2004-0074750 | A | 8/2004 |
| KR | 10-2013-0137990 | A | 12/2013 |

* cited by examiner

IMAGE FORMING DEVICE AND CONTROL METHOD FOR GENERATING A PLURALITY OF TONER IMAGES

TECHNICAL FIELD

The disclosure relates to an image forming device and a control method thereof. More particularly, the disclosure relates to an image forming device and a control method thereof that perform tone recursive control (TRC) or auto color registration (ACR).

BACKGROUND

Generally, an image forming device such as a printer, a copying machine or a facsimile generates an electrostatic latent image by irradiating image information onto a charged photosensitive drum by using an exposure module, and develops the electrostatic latent image by using toner. Further, the image forming device may form an image on a printing medium by transferring and fixing a toner image onto the printing medium.

Here, the image forming device sequentially generates a yellow image, a magenta image, a cyan image, and a black image, and combines them to generate a color image.

Further, the image forming device may perform tone recursive control (TRC) and auto color registration (ACR) to generate a clearer and more accurate image.

However, as an image forming device sequentially generates a yellow test pattern, a magenta test pattern, a cyan test pattern and a black test pattern for TRC or ACR, it takes a long time to perform tone recursive control or auto color registration.

DETAILED DESCRIPTION

Figure 1:
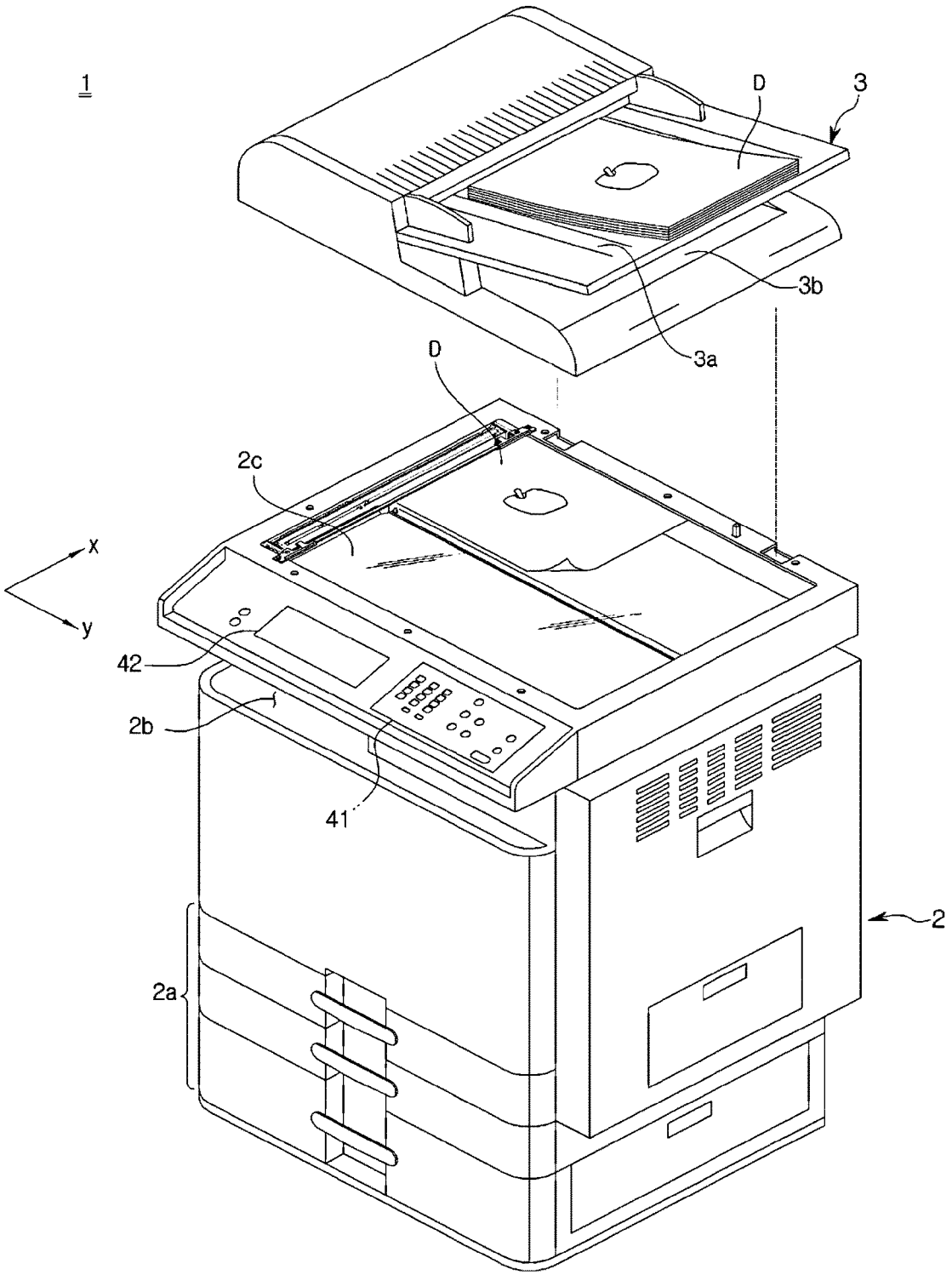
FIG. 1 illustrates an outer appearance of an image forming device according to an example.

Reference will now be made to examples, which are illustrated in the accompanying drawings, wherein like reference numerals refer to like elements throughout. In this regard, the present examples may have different forms and should not be construed as being limited to the descriptions set forth herein. For example, there may be alternative variation examples that can replace the examples at the point of the filing of the present application.

The terms used in the present specification are merely used to describe particular examples, and are not intended to limit the present disclosure.

For example, an expression used in the singular encompasses the expression of the plural, unless it has a clearly different meaning in the context.

In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

In addition, in the present description, terms including ordinal numbers such as "first," "second," etc. are used to distinguish one element from another element, and should not be defined by these terms.

In addition, terms such as "unit," "device," "block," "member," "module" etc. used in the present specification may denote a unit for processing at least one function or operation. For example, the terms may denote at least one process performed using at least one piece of hardware, such as a field programmable gate array (FPGA) or an application-specific integrated circuit (ASIC), at least one piece of software stored in a memory or a processor.

Hereinafter, an example of the present disclosure will be described with reference to the attached drawings. Like reference numerals or symbols presented in the attached drawings may denote like components or elements performing substantially the same functions.

In the following description, an image forming device and a control method thereof for minimizing a period of time for performing tone recursive control or auto color registration may be provided.

Figure 2:
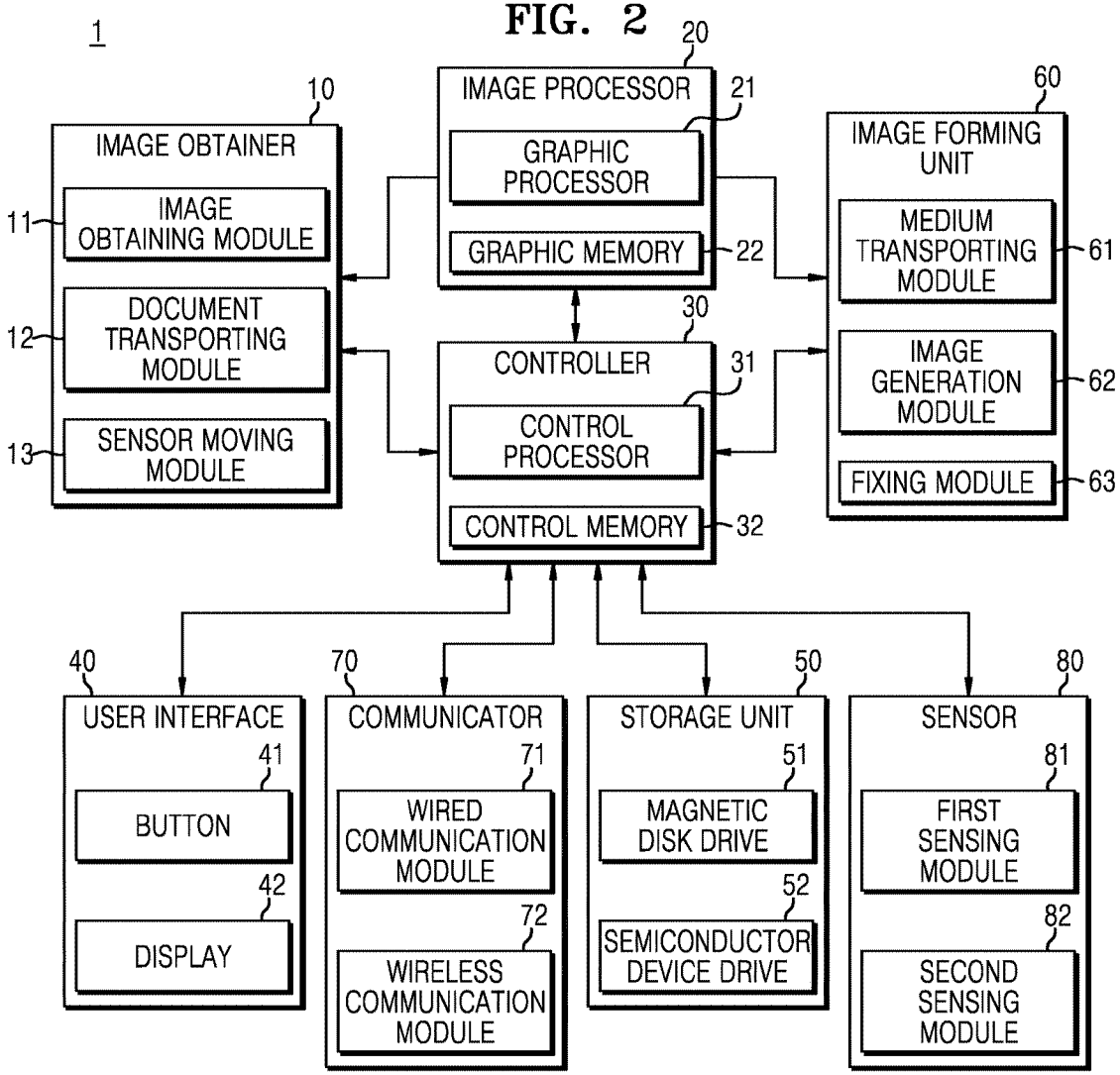
FIG. 2 illustrates a control configuration of an image forming device according to an example.

FIG. 1 illustrates an outer appearance of an image forming device 1 according to an example, and FIG. 2 illustrates a control configuration of the image forming device 1 according to an example. In addition, FIG. 3 illustrates a lateral cross-section of the image forming device 1 according to an example.

Figure 3:
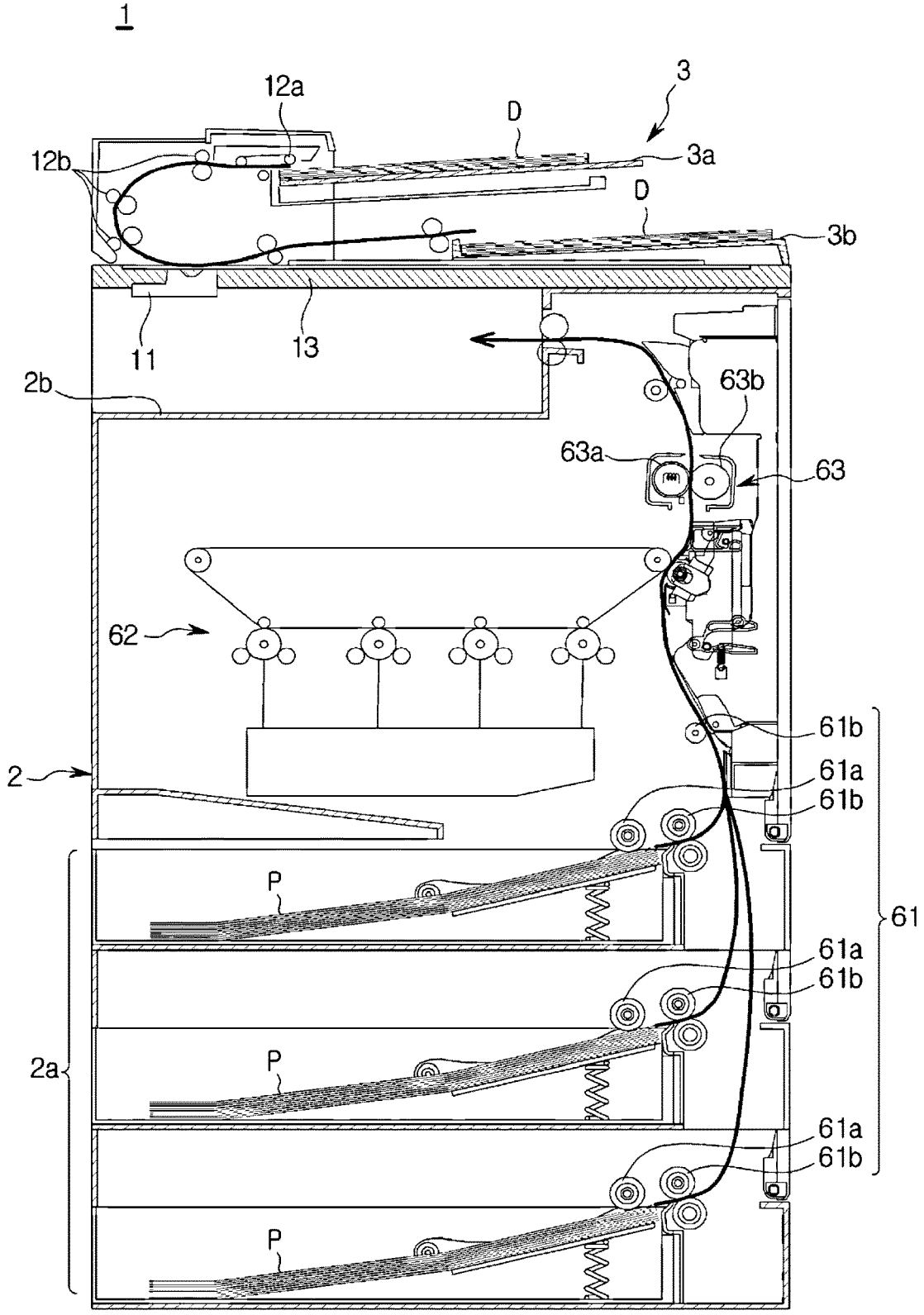
FIG. 3 illustrates a lateral cross-section of an image forming device according to an example.

Referring to FIGS. 1 to 3, the image forming device 1 may obtain an image formed on a surface of a document D and form the obtained image on a printing medium P. Here, the document D refers to a paper, a film, a cloth or the like, on a surface of which an image such as a character or a picture is formed, and the printing medium P refers to a paper, a film, a cloth or the like, on a surface of which an image such as a character or a picture may be formed.

Representative examples of the image forming device 1 include a printer that prints an image received through communication, on a printing medium P. However, the image forming device 1 is not limited to a printer and may be a copying machine obtaining an image formed on a surface of a document D and printing the image on a printing medium P, a scanner obtaining and storing an image formed on a surface of a document D, a facsimile transmitting an image formed on a surface of a document D through communication or printing an image received through communication, a multifunction device capable of performing all the functions of the printer, the copying machine, the scanner, and the facsimile described above, and the like.

A configuration of the image forming device 1 will be described with reference to FIGS. 1, 2, and 3.

Referring to FIG. 1, the image forming device 1 may include a main body 2 and a flatbed cover 3 covering an upper surface of the main body 2 in external appearance.

The main body 2 forms the outer appearance of the image forming device 1, and may receive and protect main elements of the image forming device 1 described below.

A paper feeding tray 2*a* storing a printing medium P may be provided under the main body 2, and a discharging tray 2*b* to which a printing medium P on which an image is formed is discharged may be provided.

In addition, a flatbed 2*c* formed of a transparent material may be provided on an upper surface of the main body 2 such that the image forming device 1 may obtain an image formed on a surface of the document D, and an image sensor obtaining an image formed on the surface of the document D through the transparent flatbed 2*c* may be provided under the transparent flatbed 2*c*.

The flatbed cover 3 protects the flatbed 2*c* from being exposed to external light, and may include an automatic document feeder (ADF) that automatically transports a document D on which an image is formed. The flatbed cover 3 may also be provided with a paper feeding tray 3*a* on which a document D is placed and a discharging tray 3*b* through which the document D is discharged.

Referring to FIG. 2, functionally, the image forming device 1 includes an image obtainer 10, a user interface 40, a storage unit 50, a communicator 70, an image forming unit 60, a sensor 80, an image processor 20, and a controller 30.

The image obtainer 10 may obtain an image formed on a surface of the document D and output image data corresponding to the obtained image.

The image obtainer 10 may include an image obtaining module 11 obtaining an image formed on a surface of the document D, a document transporting module 12 transporting the document D, and a sensor moving module 13 moving the image obtaining module 11.

The image obtaining module 11 may include a plurality of light-emitting elements (e.g., a photodiode, etc.) arranged in a series and a plurality of photo-detecting elements (e.g., photo-sensors, etc.) arranged in a series. As a plurality of photo-detectors arranged in a series as described above may be used to obtain one-dimensional images, the photo-detectors are generally referred to as a "linear image sensor."

To obtain a two-dimensional image from an image formed on a surface of the document D by using the linear image sensor, the image forming device 1 may move the image obtaining module 11 or transport the document D.

For example, when the document D is placed on the flatbed 2*c*, the image forming device 1 may move the image obtaining module 11 by using the sensor moving module 13, and control the image obtaining module 11 to obtain an image of the document D while the image obtaining module 11 is being moved.

In addition, when the document D is placed on the paper feeding tray 3*a* of the flatbed cover 3, the image forming device 1 may transport the document D by using the document transporting module 12, and control the image obtaining module 11 to obtain an image of the document D while the document D is being moved.

The document transporting module 12 transports the document D placed on the paper feeding tray 3*a* of the flatbed cover 3 to the discharging tray 3*b* along a transport path, and may include a pick-up roller 12*a* picking up the document D placed on the paper feeding tray 3*a* of the flatbed cover 3 and a transport roller 12*b* transporting the picked-up document D to the discharging tray 3*b*. At this time, the document transporting module 12 may transport the document D in a direction perpendicular to a direction in which a light-receiving element included in the image obtaining module 11 is arranged.

The sensor moving module 13 may move the image obtaining module 11 to obtain a two-dimensional image of the document D placed on the flatbed 2*c*. The sensor moving module 13 may include a guide bar for guiding transporting of the image obtaining module 11 and a movement motor for moving the image obtaining module 11. Here, the sensor moving module 13 may move the image obtaining module 11 in a direction perpendicular to a direction in which the light-receiving element included in the image obtaining module 11 is arranged.

The user interface 40 may interact with a user.

For example, the user interface 40 may receive, from a user, an input such as a color/mono setting according to which the image forming device 1 obtains a color image or a monochromatic image formed in the document D, a resolution setting for obtaining an image formed in the document D, or the like.

Further, the user interface 40 may display set values input by the user, an operational state of the image forming device 1, or the like.

The user interface 40 may include a plurality of buttons 41 via which predetermined user inputs are received from the user and a display 42 displaying various types of information.

The storage unit 50 may store control programs and control data for controlling the image forming device 1, and various application programs and application data via which various functions according to user input are performed.

For example, the storage unit 50 may store an operating system (OS) program for managing elements and resources (e.g., software and hardware) included in the image forming device 1, an image replay program for displaying an image of the document D, or the like.

For example, the storage unit 50 may store a test pattern for Tone Recursive Control (TRC) or a test pattern for Auto Color Registration (ACR).

The storage unit 50 may include a nonvolatile memory in which no program or data is lost even if the power is turned off. For example, the storage unit 50 may include a magnetic disk drive (e.g., a Hard Disk Drive) 51, a semiconductor device drive (e.g., a Solid State Drive) 52, or the like.

The communicator 70 may transmit or receive data to or from an external device. For example, the communicator 70 may receive image data from a user's desktop terminal or image data from a user's portable terminal.

The communicator 70 may include a wired communication module 71 that transmits or receives data to or from an external device in a wired manner via electric wires and a wireless communication module 72 that transmits or receives data to or from an external device in a wireless manner via radio waves.

The wired communication module 71 may be an Ethernet™ module, a token ring module, a Universal Serial Bus (USB) communication module, a digital subscriber line (DSL) module, a point-to-point protocol (PPP) module, or the like.

The wireless communication module 72 may include a Wi-Fi™ module, a Bluetooth™ module, a ZigBee module, a Near Field Communication (NFC) module, and the like.

The image forming unit 60 may form an image on a printing medium P according to image data. In more detail, the image forming unit 60 may pick up a printing medium P accommodated in the paper feeding tray 2*a*, form an image on the picked-up printing medium P, and discharge the printing medium P on which the image is formed, to the discharging tray 2*b*.

The image forming unit 60 may include a medium transporting module 61, an image generation module 62, and a fixing module 63.

The medium transporting module 61 transports the printing medium P from the paper feeding tray 2*a* to the discharging tray 2*b* along a transporting path, and may include a pick-up roller 61*a* picking up the printing medium P from the paper feeding tray 2*a*, and a transport roller 61*b* transporting the picked-up printing medium P to the discharging tray 2*b*.

The image generation module 62 may generate an image corresponding to image data and transfer the generated image to the printing medium P. In more detail, the image generation module 62 may continuously generate one-dimensional images and sequentially transfer the generated one-dimensional images to the printing medium P. As a result, a two-dimensional image corresponding to the image data is formed on the printing medium P.

In addition, the image generation module 62 may generate a plurality of images having a basic color and mix the plurality of images to form a color image of various colors.

For example, yellow, magenta, and cyan are widely known as the three primary colors. By mixing yellow, magenta, and cyan at diverse ratios, diverse colors may be realized.

Thus, the image generation module 62 may respectively generate a yellow image, a magenta image, a cyan image, and a black image, and mix the yellow image, the magenta image, the cyan image, and the black image.

The features of the image generation module 62 will be described in more detail below.

The fixing module 63 fixes a toner image transferred to the printing medium P, to the printing medium P, through heat and pressure. The fixing module 63 may include a heating roller 63*a* heating the printing medium P, to which the toner image is transferred, and a pressure roller 63*b* pressing the printing medium P, to which the toner image is transferred.

As described above, the image forming unit 60 may form a two-dimensional image on the printing medium P by sequentially forming one-dimensional images on the printing medium P while the printing medium P is being transported.

The sensor 80 may obtain information related to the toner image generated using the image generation module 62. For example, the sensor 80 may sense a concentration of toner forming the toner image, or may sense a pattern of the toner image.

The sensor 80 may include a first sensing module 81 sensing a concentration of toner forming the toner image and outputting an electrical signal corresponding to the concentration of the toner image and a second sensing module 82 sensing a pattern of the toner image and outputting an electrical signal corresponding to the sensed pattern.

Features of the sensor 80 will be described in more detail below.

The image processor 20 may analyze and process an image obtained using the image obtainer 10 or an image received through the communicator 70. Further, the image processor 20 may transmit an image to be formed on the printing medium P to the image forming unit 60.

For example, the image processor 20 may classify an image obtained using the image obtainer 10 or an image received through the communicator 70 as a black image, a cyan image, a magenta image, and a yellow image.

Further, the image processor 20 may divide each of the black image, the cyan image, the magenta image, and the yellow image into a plurality of one-dimensional images, and transmit the plurality of divided, one-dimensional images to the image forming unit 60 in order.

The image processor 20 may include a graphic processor 21 performing calculations for processing images, and a graphic memory 22 storing a program or data related to the calculations performed by the graphic processor 21.

The graphic processor 21 may include an arithmetic and logic unit (ALU) for performing calculations for image processing, and a memory circuit for storing data to be used in the calculations or calculated data.

The graphic memory 22 may include a volatile memory such as a static random access memory (SRAM), a dynamic random access memory (DRAM) or the like and a non-volatile memory such as a read-only memory, an erasable programmable read-only memory (EPROM), an electrically erasable programmable read-only memory (EEPROM), a flash memory or the like.

Although the graphic processor 21 and the graphic memory 22 are described as being functionally distinguished, the graphic processor 21 and the graphic memory 22 are not necessarily physically distinguished. For example, the graphic processor 21 and the graphic memory 22 may be implemented as separate chips as well as a single chip.

The controller 30 may control operations of the image obtainer 10, the user interface 40, the storage unit 50, the image forming unit 60, the communicator 70, the sensor 80, and the image processor 20 described above.

For example, the controller 30 may control the image processor 20 such that the image processor 20 transmits a one-dimensional image to the image forming unit 60, and control the image forming unit 60 such that the image forming unit 60 generates a toner image according to the one-dimensional image transmitted by the image processor 20.

In addition, the controller 30 may control the sensor 80 to sense a toner concentration of the toner image generated using the image forming unit 60 or control the sensor 80 to detect a pattern of the toner image generated using the image forming unit 60.

The controller 30 may include a control processor 31 performing calculations for controlling operation of the image forming device 1 and a control memory 32 storing programs and data related to a calculation operation performed by the control processor 31.

The control processor 31 may include an arithmetic and logic unit (ALU) performing an operation for controlling calculations of the image forming device 1, and a memory circuit storing data to be used in the calculations or calculated data.

The control memory 32 may include a volatile memory such as an SRAM, a DRAM or the like and a non-volatile memory such as a read only memory, an EPROM, an EEPROM, a flash memory or the like.

Although the control processor 31 and the control memory 32 are described as being functionally distinguished, the control processor 31 and the control memory 32 are not necessarily physically distinguished. For example, the control processor 31 and the control memory 32 may be implemented as separate chips as well as a single chip.

Although the image processor 20 and the controller 30 are described as being functionally distinguished from each other, the image processor 20 and the controller 30 are not necessarily physically distinguished. For example, the image processor 20 and the controller 30 may be implemented as separate chips as well as a single chip.

Features of the image generation module 62 and the sensor 80 will be described below.

Figure 4:
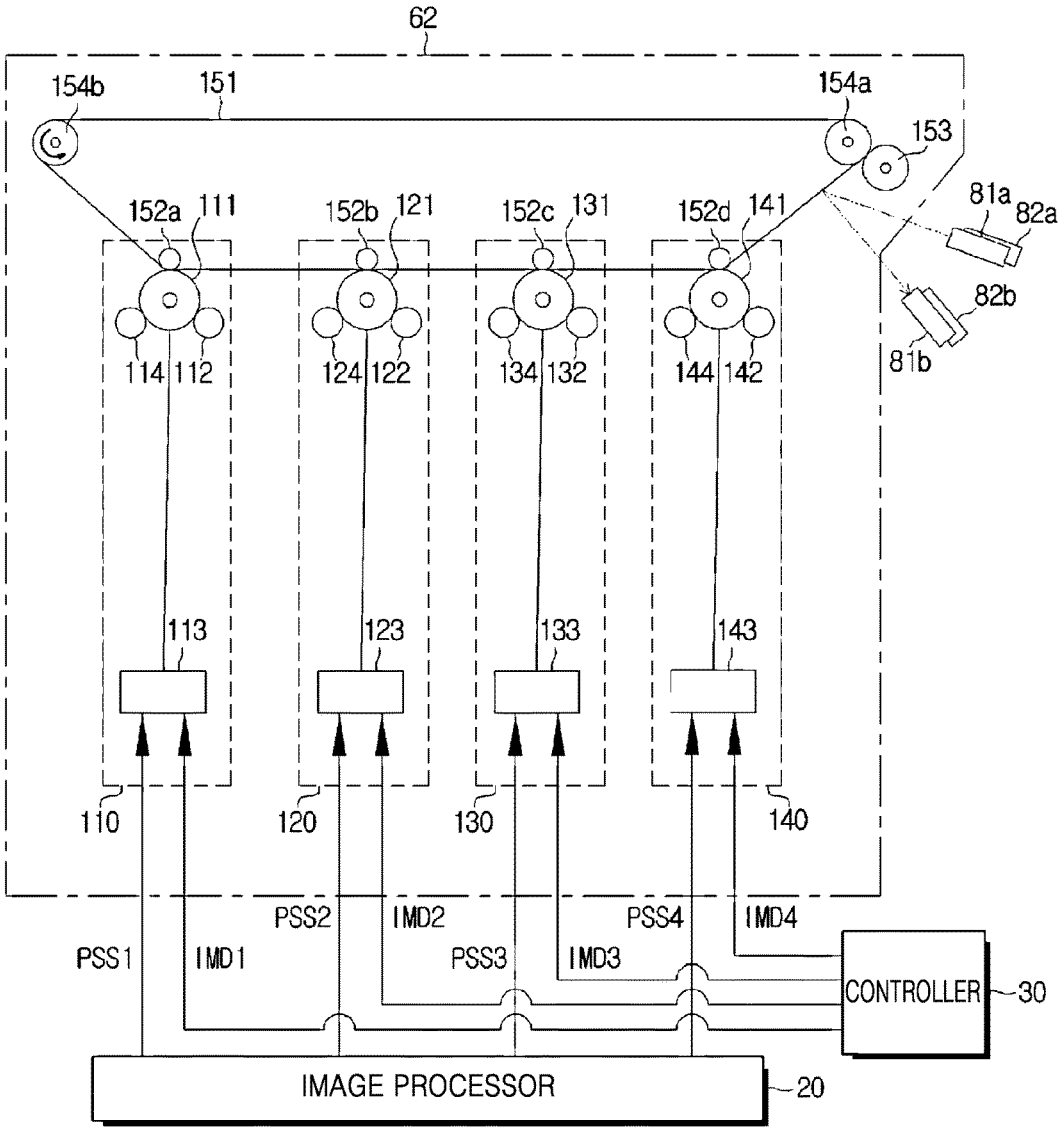
FIG. 4 illustrates an image generation module and a sensor included in an image forming device according to an example.
Figure 5:
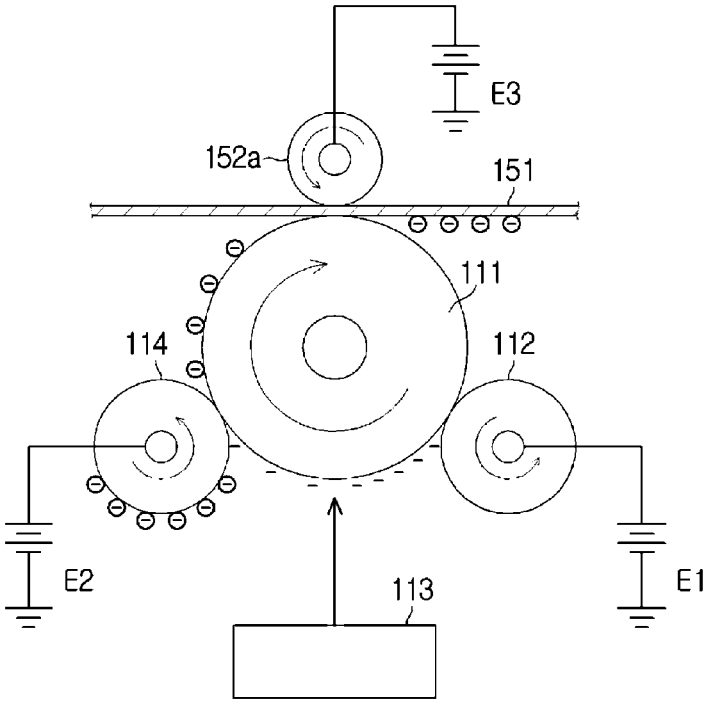
FIG. 5 illustrates an image generation process of an image generation module included in an image forming device according to an example.

FIG. 4 illustrates an image generation module 62 and a sensor included in an image forming device 1 according to an example, and FIG. 5 illustrates an image generation process of an image generation module 62 included in an image forming device 1 according to an example.

Referring to FIGS. 4 and 5, the image generation module 62 includes a plurality of image generation modules 110, 120, 130, and 140 generating toner images of different colors to generate images of various colors and a transfer module transferring the toner image generated using the image generation modules 110, 120, 130, and 140 to a printing medium P.

Referring to FIG. 4, the image generation module 62 may include a first image generation module 110 generating a yellow toner image, a second image generation module 120 generating a magenta toner image, a third image generation module 130 generating a cyan toner image, and a fourth image generation module 140 generating a black toner image.

The first image generation module 110 may generate a yellow image according to a control signal of the controller 30 and image data of the image processor 20, and may include a first photosensitive drum (e.g., an organic photo conductor drum (OPC drum)) 111, a first charging roller 112, a first exposure device 113, and a first developing roller 114.

The first photosensitive drum 111 may have a cylindrical shape and may convert image data, which is an electrical signal, into an electrostatic latent image, together with the first exposure device 113, which will be described below.

An outer circumferential surface of the first photosensitive drum 111 may be charged with a positive charge (+) or a negative charge (−) by a voltage applied from the outside. In other words, the outer circumferential surface of the first photosensitive drum 111 may have electrical polarity due to a voltage applied from the outside.

When light is irradiated to the outer circumferential surface of the first photosensitive drum 111 charged in this manner, the outer circumferential surface of the first photosensitive drum 111 may be discharged. In other words, when light is irradiated to the charged outer circumferential surface of the first photosensitive drum 111, the outer circumferential surface of the first photosensitive drum 111 may lose electrical polarity.

The first charging roller 112 may apply a voltage to the outer circumferential surface of the first photosensitive drum 111 such that the outer circumferential surface of the first photosensitive drum 111 is charged while the first photosensitive drum 111 rotates. For example, as illustrated in FIG. 5, the first charging roller 112 may apply a voltage of −1,000 V to −2,000 V to the outer circumferential surface of the first photosensitive drum 111 by a first power source E1.

As a result, the outer circumferential surface of the first photosensitive drum 111 is charged by the negative charge (−), and an electric potential thereof may be lowered. For example, when a voltage of −1,500 V is applied to the outer circumferential surface of the first photosensitive drum 111, an electric potential of the outer circumferential surface of the first photosensitive drum 111 may be approximately −650 V.

The first exposure device 113 receives a page sync signal (e.g., a first page sync signal) for generating a yellow image from the controller 30 and image data representing a yellow image from the image processor 20, and emits light to the outer circumferential surface of the first photosensitive drum 111 charged using the first charging roller 112.

In more detail, when the first exposure device 113 receives a first page sync signal PSS1 (e.g., a control signal for generating a yellow image) from the controller 30, the first exposure device 113 may emit light to the outer circumferential surface of the first photosensitive drum 111 according to first image data IMD1 (e.g., image data representing a yellow image) received from the image processor 20. For example, the first exposure device 113 may irradiate light to a portion where a toner image is generated by the first image data IMD1, and may not irradiate light to a portion where no toner image is generated.

As described above, a portion of the charged outer circumferential surface of the first photosensitive drum 111, to which light is irradiated, loses negative (−) charges. Further, an electric potential of the portion irradiated with light increases due to the loss of the negative (−) charges. For example, when the outer circumferential surface of the first photosensitive drum 111 is charged to approximately −650 V by the first charging roller 112, an electric potential of the portion irradiated with light may be increased to approximately −100 V.

As a result, a hidden image due to electrostatic charges, that is, an electrostatic latent image, is formed on the outer circumferential surface of the first photosensitive drum 111. The electrostatic latent image is formed by the negative (−) charges on the outer circumferential surface of the first photosensitive drum 111, and is not visually recognized.

In addition, the first exposure device 113 may include a laser scanner (LSU) or an LED print head (LPH). Here, the laser scanner may include a light source that emits light and a reflecting mirror that rotates by a motor to reflect light emitted from the light source using the rotating reflecting mirror, thereby scanning light to the first photosensitive drum 111. In addition, the LED print head may include an LED array to directly irradiate light to the first photosensitive drum 111.

The first developing roller 114 may develop an electrostatic latent image formed on the outer circumferential surface of the first photosensitive drum 111 by using yellow toner.

In more detail, the first developing roller 114 may charge yellow toner and supply the charged yellow toner to the outer circumferential surface of the first photosensitive drum 111. For example, a voltage of approximately −450 V may be applied to the first developing roller 114 by a second power source E2 as shown in FIG. 5. Further, when a voltage of −450 V is applied to the first developing roller 114, the yellow toner may be charged by a negative (−) charge.

Further, the electrostatic latent image formed on the outer circumferential surface of the first photosensitive drum 111 may be developed by the charged yellow toner. In other words, the yellow toner adheres to an exposed portion of the outer circumferential surface of the first photosensitive drum 111 due to electrostatic attraction, and the yellow toner does not adhere to an unexposed portion.

In the example described above, an electric potential of the unexposed portion of the outer circumferential surface of the first photosensitive drum 111 is approximately −650 V, and an electric potential of the exposed portion of the outer circumferential surface of the first photosensitive drum 111 is approximately −100 V. Here, when a voltage of −450 V is applied to the first developing roller 114, a charge of the first developing roller 114 adheres to an exposed portion of the outer circumferential surface of the first photosensitive drum 111 due to electrostatic attraction, and is not adhered to the unexposed portion.

As a result, a yellow toner image corresponding to the electrostatic latent image may be generated on the outer circumferential surface of the first photosensitive drum 111.

As described above, the first image generation module 110 may generate a yellow toner image on the outer circumferential surface of the first photosensitive drum 111 according to the first page sync signal PSS1 of the controller 30 and the first image data IMD1 of the image processor 20.

The second image generation module 120 may generate a magenta image according to a control signal of the controller 30 and image data of the image processor 20, and may include a second photosensitive drum 121, a second charging roller 122, a second exposure device 123, and a second developing roller 124.

Features and operations of the second photosensitive drum 121 and the second charging roller 122 are the same as those of the first photosensitive drum 111 and the first charging roller 112 described above. Therefore, descriptions of the second photosensitive drum 121 and the second charging roller 122 are omitted.

The second exposure device 123 receives a page sync signal (e.g., a second page sync signal PSS2) for generating a magenta image from the controller 30 and image data (e.g., a second image data IMD2) representing a magenta image from the image processor 20, and emits light to the outer circumferential surface of the second photosensitive drum 121 charged using the second charging roller 122.

In more detail, when the second exposure device 123 receives a second page sync signal PSS2 (e.g., a control signal for generating a magenta image) from the controller 30, the second exposure device 123 may emit light to the outer circumferential surface of the second photosensitive drum 121 according to second image data IMD2 (e.g., an image data representing a magenta image) received from the image processor 20.

A portion of the charged outer circumferential surface of the second photosensitive drum 121 loses charges, and a hidden image due to electrostatic charges, that is, an electrostatic latent image, is formed on the outer circumferential surface of the second photosensitive drum 121.

In addition, the second exposure device 123 may include an LSU or an LPH.

The second developing roller 124 may develop an electrostatic latent image formed on the outer circumferential surface of the second photosensitive drum 121 by using magenta toner.

In more detail, the second developing roller 124 may charge magenta toner and supply the charged magenta toner to the outer circumferential surface of the second photosensitive drum 121.

Further, the electrostatic latent image formed on the outer circumferential surface of the second photosensitive drum 121 may be developed by the charged magenta toner. In other words, the magenta toner adheres to an exposed portion of the outer circumferential surface of the second photosensitive drum 121 due to electrostatic attraction, and the magenta toner does not adhere to an unexposed portion.

As a result, a magenta toner image corresponding to the electrostatic latent image may be generated on the outer circumferential surface of the second photosensitive drum 121.

As described above, the second image generation module 120 may generate a magenta toner image on the outer circumferential surface of the second photosensitive drum 121 according to the second page sync signal PSS2 of the controller 30 and the second image data IMD2 of the image processor 20.

The third image generation module 130 may generate a cyan image according to a control signal of the controller 30 and image data of the image processor 20, and may include a third photosensitive drum 131, a third charging roller 132, a third exposure device 133, and a third developing roller 134.

Features and operations of the third photosensitive drum 131 and the third charging roller 132 are the same as those of the first photosensitive drum 111 and the first charging roller 112 described above. Therefore, descriptions of the third photosensitive drum 131 and the third charging roller 132 are omitted.

The third exposure device 133 receives a page sync signal (e.g., a third page sync signal PSS3) for generating a cyan image from the controller 30 and image data (e.g., a third image data IMD3) representing a cyan image from the image processor 20, and emits light to the outer circumferential surface of the third photosensitive drum 131 charged using the third charging roller 132.

In more detail, when the third exposure device 133 receives a third page sync signal PSS3 (e.g., a control signal for generating a cyan image) from the controller 30, the third exposure device 133 may emit light to the outer circumferential surface of the third photosensitive drum 131 according to third image data IMD3 (e.g., image data representing a cyan image) received from the image processor 20.

A portion of the charged outer circumferential surface of the third photosensitive drum 131 loses charges, and a hidden image due to electrostatic charges, that is, an electrostatic latent image, is formed on the outer circumferential surface of the third photosensitive drum 131.

In addition, the third exposure device 133 may include an LSU or an LPH.

The third developing roller 134 may develop the electrostatic latent image formed on the outer circumferential surface of the third photosensitive drum 131 by using cyan toner.

In more detail, the third developing roller 134 may charge cyan toner and supply the charged cyan toner to the outer circumferential surface of the third photosensitive drum 131.

The electrostatic latent image formed on the outer circumferential surface of the third photosensitive drum 131 may be developed by the charged cyan toner. In other words, the cyan toner adheres to an exposed portion of the outer circumferential surface of the third photosensitive drum 131 due to electrostatic attraction, and the cyan toner does not adhere to an unexposed portion.

As a result, a cyan toner image corresponding to the electrostatic latent image may be generated on the outer circumferential surface of the third photosensitive drum 131.

As described above, the third image generation module 130 may generate a cyan toner image on the outer circumferential surface of the third photosensitive drum 131 according to the third page sync signal PSS3 of the controller 30 and the third image data IMD3 of the image processor 20.

The fourth image generation module 140 may generate a black image according to a control signal of the controller 30 and image data of the image processor 20, and may include a fourth photosensitive drum 141, a fourth charging roller 142, a fourth exposure device 143, and a fourth developing roller 144.

Features and operations of the fourth photosensitive drum 141 and the fourth charging roller 142 are the same as those of the first photosensitive drum 111 and the first charging roller 112 described above. Therefore, descriptions of the fourth photosensitive drum 141 and the fourth charging roller 142 are omitted.

The fourth exposure device 143 receives a page sync signal (e.g., a fourth page sync signal PSS4) for generating a black image from the controller 30 and image data (e.g., fourth image data IMD4) representing a black image from the image processor 20, and emits light to the outer circumferential surface of the fourth photosensitive drum 141 charged using the fourth charging roller 142.

In more detail, when the fourth exposure device 143 receives a fourth page sync signal PSS4 (e.g., a control signal for generating a yellow image) from the controller 30, the fourth exposure device 123 may emit light to the outer circumferential surface of the fourth photosensitive drum 141 according to fourth image data IMD4 (e.g., image data representing a black image) received from the image processor 20.

In addition, the fourth exposure device 143 may include an LSU or an LPH.

A portion of the charged outer circumferential surface of the fourth photosensitive drum 141 loses charges, and a hidden image due to electrostatic charges, that is, an electrostatic latent image, is formed on the outer circumferential surface of the fourth photosensitive drum 141.

The fourth developing roller 144 may develop the electrostatic latent image formed on the outer circumferential surface of the fourth photosensitive drum 141 by using black toner.

In more detail, the fourth developing roller 144 may charge black toner and supply the charged black toner to the outer circumferential surface of the fourth photosensitive drum 141.

The electrostatic latent image formed on the outer circumferential surface of the fourth photosensitive drum 141 may be developed by the charged black toner. In other words, the black toner adheres to an exposed portion of the outer circumferential surface of the fourth photosensitive drum 141 due to electrostatic attraction, and the black toner does not adhere to an unexposed portion.

As a result, a black toner image corresponding to the electrostatic latent image may be generated on the outer circumferential surface of the fourth photosensitive drum 141.

As described above, the fourth image generation module 140 may generate a black toner image on the outer circumferential surface of the fourth photosensitive drum 141 according to the fourth page sync signal PSS4 of the controller 30 and the fourth image data IMD4 of the image processor 20.

As illustrated in FIG. 4, the transfer module may include a transfer belt 151 via which a plurality of toner images are combined to be transferred to a printing medium P, a plurality of primary transfer rollers 152*a*, 152*b*, 152*c*, and 152*d* transferring toner images generated using the plurality of image generation modules 110, 120, 130, and 140 to the transfer belt 151, and a secondary transfer roller 153 transferring the toner images transferred to the transfer belt 151 to the printing medium P.

The transfer belt 151 may combine a yellow toner image generated using the first image generation module 110, a magenta toner image generated using the second image generation module 120, a cyan toner image generated using the third image generation module 130, and a black image generated using the fourth image generation module 140, and transfer the combined toner images to the printing medium P.

For example, as illustrated in FIG. 4, while the transfer belt 151 rotates counterclockwise, the yellow toner image of the first photosensitive drum 111, the magenta toner image of the second photosensitive drum 121, the cyan toner image of the third photosensitive drum 131, and the black toner image of the fourth photosensitive drum 141 are sequentially transferred to the transfer belt 151.

As a result, the yellow toner image, the magenta toner image, the cyan toner image, and the black toner image are combined on the transfer belt 151, thereby generating a color toner image.

The plurality of primary transfer rollers 152*a*, 152*b*, 152*c*, and 152*d* may include a first primary transfer roller 152*a* transferring a yellow toner image of the first photosensitive drum 111 to the transfer belt 151, a second primary transfer roller 152*b* transferring a magenta toner image of the second photosensitive drum 121 to the transfer belt 151, a third primary transfer roller 152*c* transferring a cyan toner image of the third photosensitive drum 131 to the transfer belt 151, and a fourth primary transfer roller 152*d* transferring a black toner image of the fourth photosensitive drum 141 to the transfer belt 151.

In more detail, the first primary transfer roller 152*a* may transfer a yellow toner image formed on the outer circumferential surface of the first photosensitive drum 111 to the transfer belt 151 by electrostatic attraction. For example, a voltage of about +1,000 V to +2,000 V may be applied to the first primary transfer roller 152*a* by a third power source E3. Further, according to contact between the transfer belt 151 and the first primary transfer roller 152*a*, a voltage from +1,000 V to +2,000 V may be applied to a portion of the transfer belt 151 that contacts the first primary transfer roller 152*a*.

In the example described above, the yellow toner adhered to the first photosensitive drum 111 is charged by a negative (−) charge. Here, when a voltage of +1,000 V to +2,000 V is applied to the transfer belt 151, the yellow toner of the first photosensitive drum 111 is moved to the transfer belt 151 due to electrostatic attraction.

As a result, the yellow toner image formed on the outer circumferential surface of the first photosensitive drum 111 is transferred to the transfer belt 151.

In addition, the second primary transfer roller 152*b* may transfer a magenta toner image formed on the outer circumferential surface of the second photosensitive drum 121 to the transfer belt 151 by electrostatic attraction. As described above, the magenta toner image formed on the outer circumferential surface of the second photosensitive drum 121 by using the second primary transfer roller 152*b* is transferred to the transfer belt 151.

In addition, the third primary transfer roller 152*c* may transfer a cyan toner image formed on the outer circumferential surface of the third photosensitive drum 131 to the transfer belt 151 by electrostatic attraction. As described above, the cyan toner image formed on the outer circumferential surface of the third photosensitive drum 131 by using the third primary transfer roller 152*c* is transferred to the transfer belt 151.

In addition, the fourth primary transfer roller 152*d* may transfer a black toner image formed on the outer circumferential surface of the fourth photosensitive drum 141 to the transfer belt 151 by electrostatic attraction. As described above, the black toner image formed on the outer circumferential surface of the fourth photosensitive drum 141 by using the fourth primary transfer roller 152*d* is transferred to the transfer belt 151.

As described above, the plurality of primary transfer rollers 152*a*, 152*b*, 152*c*, and 152*d* respectively transfer the yellow toner image, the magenta toner image, the cyan toner image, and the black toner image to the transfer belt 151 in order. As a result, a color toner image in which the yellow toner image, the magenta toner image, the cyan toner image, and the black toner image are combined is formed on the transfer belt 151.

The secondary transfer roller 153 may transfer the color toner image generated on a surface of the transfer belt 151 to a printing medium P.

In more detail, the secondary transfer roller 153 may transfer the color toner image generated on the surface of the transfer belt 151 by electrostatic attraction. For example, a voltage of about +1,000 V to +2,000 V may be applied to the secondary transfer roller 153. In addition, due to contact between the printing medium P and the secondary transfer roller 153, a voltage of +1,000 V to +2,000 V may be applied to a portion of the printing medium P contacting the secondary transfer roller 153.

In the above-described example, toners are charged by a negative (−) charge. Here, when a voltage of +1,000 V to +2,000 V is applied to the printing medium P, due to an electrostatic attractive force, toners of the transfer belt 151 move to the printing medium P.

As a result, the color toner image formed on the surface of the transfer belt 151 is transferred to the printing medium P.

Moreover, the transfer module may further include a drive roller 154*a* rotating the transfer belt 151 and a tension roller 154*b* maintaining tautness of the transfer belt 151.

While the image generation module 62 is described by individually describing the first image generation module 110, the second image generation module 120, the third image generation module 130, the fourth image generation module 140, and the transfer module, this is merely a description of the image generation module 62 in which these are arranged according to function, and the image generation module 62 may also be physically arranged in a different manner.

For example, the first exposure device 113, the second exposure device 123, the third exposure device 133, the fourth exposure device 143, and the transfer module may be provided inside the main body 2 of the image forming device 1.

The first photosensitive drum 111, the first charging roller 112, and the first developing roller 114 may constitute a first developing device referred to as a "yellow cartridge," and the second photosensitive drum 121, the second charging roller 122, and the second developing roller 124 may constitute a second developing device referred to as a "magenta cartridge." In addition, the third photosensitive drum 131, the third charging roller 132, and the third developing roller 134 may constitute a third developing device referred to as a "cyan cartridge," and the fourth photosensitive drum 141, the fourth charging roller 142, and the fourth developing roller 144 may constitute a fourth developing device referred to as a "black cartridge." The first, second, third, and fourth developing devices may respectively be attached to the main body 2 of the image forming device 1 or may be removed from the main body 2.

The sensor 80 may include the first sensing module 81 sensing a concentration of toner forming a toner image and the second sensing module 82 sensing a pattern of the toner image.

As illustrated in FIG. 4, the first sensing module 81 may include a first light-emitting element 81*a* (e.g., a photodiode, etc.) emitting light toward a toner image and a first light-receiving element 81*b* (e.g., a photo-sensor, etc.) detecting an intensity of light reflected by the toner image.

The first light-emitting element 81*a* may emit light toward a toner image according to a control signal of the controller 30. The light emitted toward the toner image is reflected by the toner image, and the first light-receiving element 81*b* may sense an intensity of the light reflected by the toner image. Here, the intensity of the light reflected by the toner image is varied according to concentration of toner forming the toner image. In other words, the intensity of the light sensed by the first light-receiving element 81*b* may be varied according to a toner concentration.

In addition, the first sensing module 81 may output an electrical signal corresponding to the intensity of the light sensed by the first light-receiving element 81*b* to the controller 30. The controller 30 may determine a toner concentration of the toner image based on the output of the first sensing module 81.

As illustrated in FIG. 4, the second sensing module 82 may include a second light-emitting element 82*a* (e.g., a photodiode, etc.) emitting light toward a toner image and a second light-receiving element 82*b* (e.g., a photo-sensor, etc.) detecting an intensity of light reflected by the toner image.

The second light-emitting element 82*a* may emit light toward the toner image according to a control signal of the controller 30. The light emitted toward the toner image is reflected by the toner image, and the second light-receiving element 82*b* may detect an intensity of the light reflected by the toner image. Depending on a shape of the toner image, light may be reflected or may not be reflected by the toner image. In other words, depending on the shape of the toner image, the second light-receiving element 82*b* may detect or may not detect reflected light.

In addition, the second sensing module 82 may output an electrical signal corresponding to a pattern of reflected light detected using the second light-receiving element 82*b* to the controller 30. The controller 30 may determine a shape of the toner image based on the output of the second sensing module 82.

The configuration of the image forming device 1 has been described above.

Hereinafter, an image forming operation of the image forming device 1 will be described.

Figure 6:
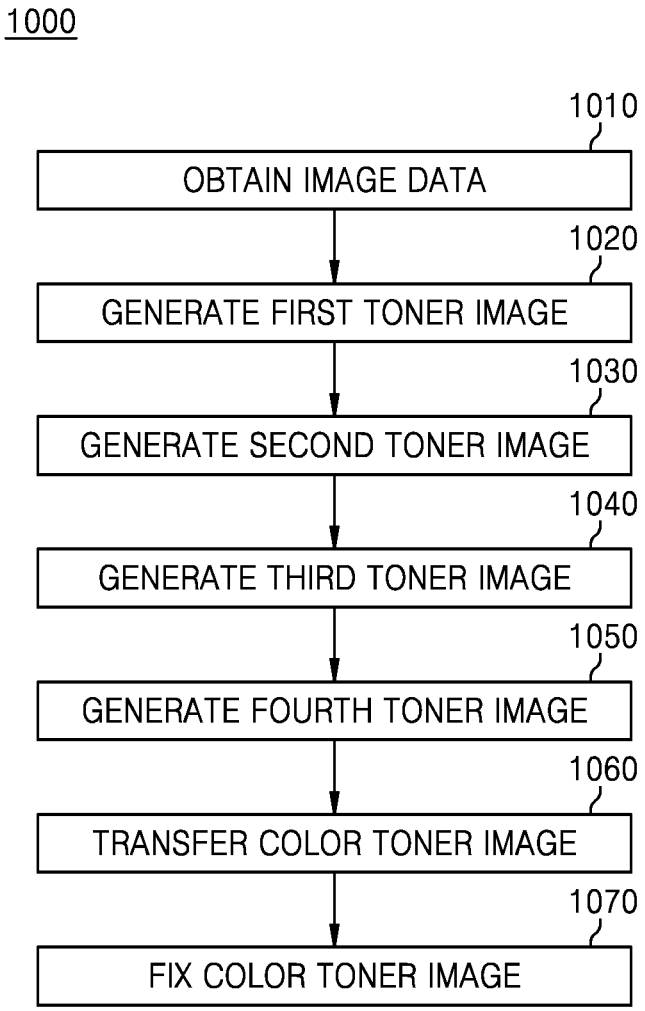
FIG. 6 illustrates an image forming method of an image forming device according to an example.
Figure 7:
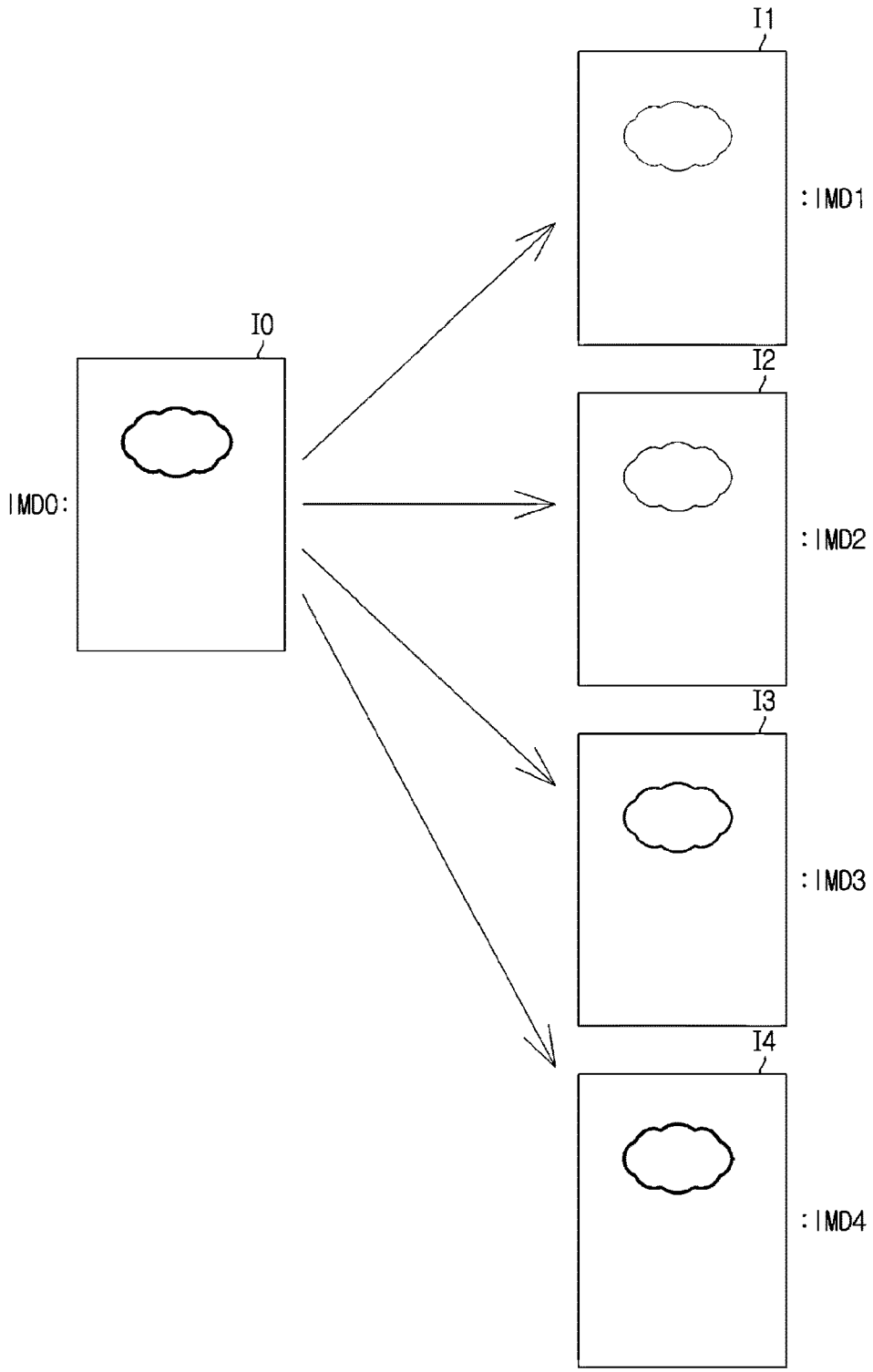
FIG. 7 illustrates obtaining of image data according to the image forming method illustrated in FIG. 6.

FIG. 6 illustrates an image forming method of an image forming device according to an example. In addition, FIG. 7 illustrates obtaining of image data according to the image forming method illustrated in FIG. 6, and FIGS. 8 through 11 illustrate generation of a toner image according to the image forming method illustrated in FIG. 6.

An image forming method 1000 of the image forming device 1 will be described with reference to FIGS. 6 through 11.

Referring to FIG. 6, the image forming device 1 obtains first, second, third, and fourth image data IMD0 (IMD1, IMD2, IMD3, IMD4) in operation 1010.

Here, the first image data IMD1 may represent a yellow image, the second image data IMD2 may represent a magenta image, the third image data IMD3 may represent a cyan image, and the fourth image data IMD4 may represent a black Image.

The first, second, third and fourth image data IMD1, IMD2, IMD3, and IMD4 may be obtained using various methods.

For example, original image data IMD0 may be obtained using the image obtainer 10 included in the image forming device 1.

When a user has placed a document D on the flatbed 2*c*, the image forming device 1 may move the image obtaining module 11 by using the sensor moving module 13, and control the image obtaining module 11 to obtain an image of the document D while the image obtaining module 11 is being moved. Here, the image obtaining module 11 may obtain original image data IMD0 corresponding to an image formed on the document D.

In addition, when a user has placed a document D on the paper feeding tray 3*a* of the flatbed cover 3, the image forming device 1 may transport the document D by using the document transporting module 14, and control the image obtaining module 11 to obtain an image of the document D while the document D is being moved. Here, the image obtaining module 11 may obtain original image data IMD0 corresponding to an image formed on the document D.

As another example, original image data IMD0 may be obtained using the communicator 70 included in the image forming device 1.

The user may perform a document job on an external device. In addition, the user may transmit a document job performed on the external device and a print command regarding the document to the image forming device 1 through communication.

Here, the document that the user has worked using the external device may be transmitted to the image forming device 1 in the form of original image data IMD0 which is recognizable by the image forming device 1.

In addition, when the document worked by the user by using the external device is not transmitted in the form of original image data IMD0, the image forming device 1 may generate original image data IMD0 from the document received from the external device.

Original image data IMD0 obtained using the image obtainer 10 or original image data IMD0 received via the communicator 70 may be RGB-type image data including red (R), green (G), and blue (B) as basic colors.

As described above, various colors may be realized by mixing three colors known as three basic colors. Here, red (R), green (G), and blue (B), which are known as the three primary colors of light, may be used by, for example, a display, in realization of colors by optical mixing. In addition, in color realization performed by using pigments such as ink, yellow (Y), magenta (M), and cyan (C) colors known as the three primary colors of color may be used.

As the image obtainer 10 obtains an image formed on a surface of the document D in an optical manner, a color image obtained using the image obtainer 10 typically consists of red (R), green (G), and blue (B).

In addition, a document job may have been performed by using a computing device, and a result of the document job is displayed to the user by using an optical display. Thus, a color image received using the communicator 70 also typically consists of red (R), green (G), and blue (B).

The image forming device 1 generates a color image by using yellow (Y) toner, magenta (M) toner, cyan (C) toner, and black (K) toner as described above.

Accordingly, the image processor 20 of the image forming device 1 may generate, from RGB-type original image data IMD0, first image data IMD1 representing a yellow image, second image data IMD2 representing a magenta image, third image data IMD3 representing a cyan image, and fourth image data IMD4 representing a black image.

Further, the image forming device 1 may perform preparation operations for image formation prior to the image formation. For example, the image forming device 1 may preheat the fixing module 63 included in the image forming unit 60, and drive laser scanners included in the first, second, third, and fourth exposure devices 113, 123, 133, and 143 in advance.

The image forming device 1 generates a first toner image I1 in operation 1020.

After the preparation operations described above, the image forming device 1 may generate toner images I1, I2, I3, and I4 to be formed on a printing medium P.

For example, the image forming device 1 may rotate the pick-up roller 61*a* and the transport roller 61*b* of the medium transporting module 61 to transport the printing medium P. Further, the image forming device 1 may rotate the drive roller 154*a* to rotate the transfer belt 151. As a result, the photosensitive drums 111, 121, 131, and 141 and the transfer rollers 152*a*, 152*b*, 152*c*, and 152*d* that are in contact with the transfer belt 151 may be rotated, and the charging rollers 112, 122, 132, and 142 and the developing rollers 114, 124, 134, and 144 that are in contact with the photosensitive drums 111, 121, 131, and 141 may be rotated.

In addition, the first image generation module 110 included in the image forming device 1 may generate a first toner image I1.

Figure 8:
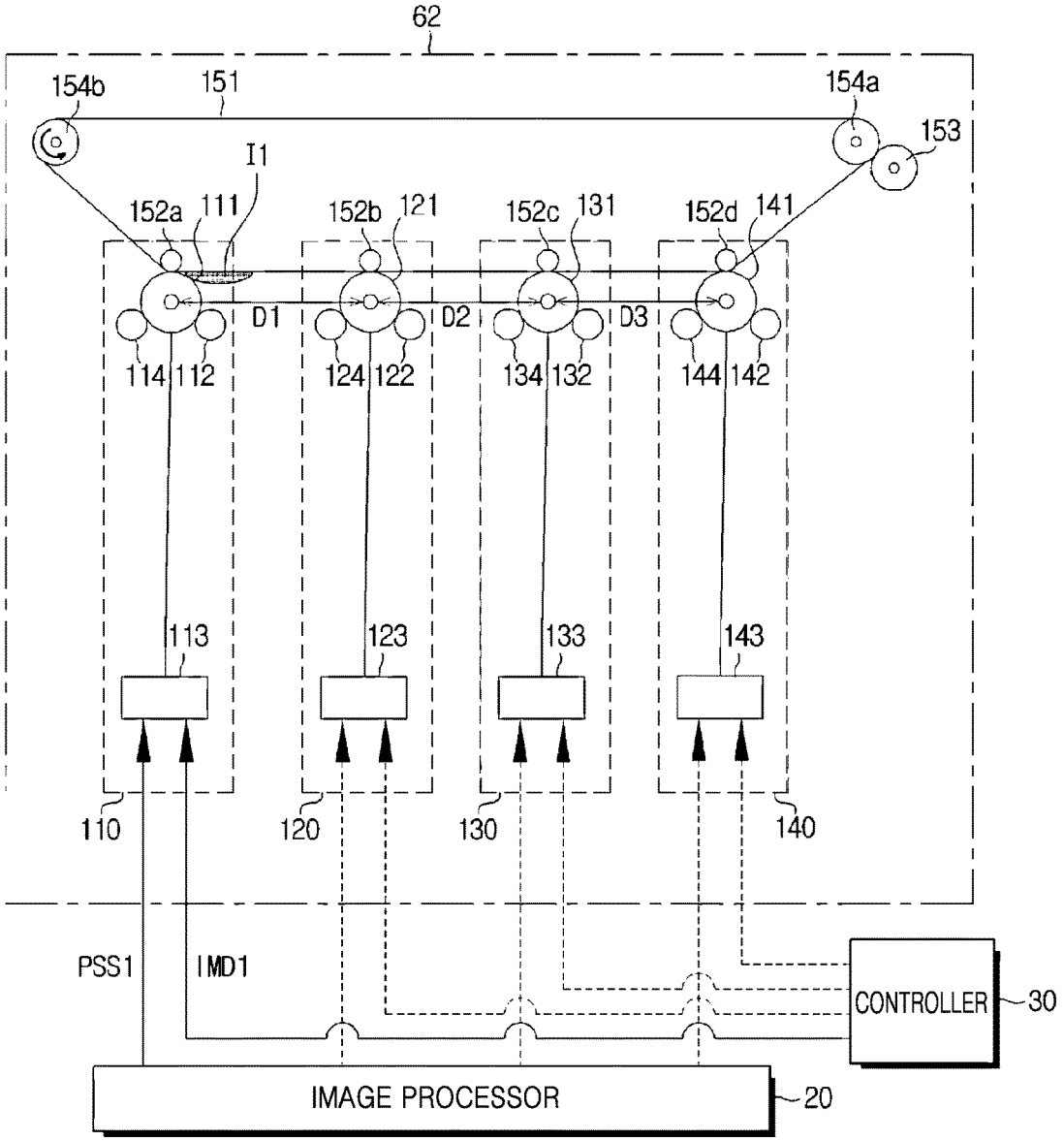
FIGS. 8 through 11 illustrate generation of a toner image according to the image forming method illustrated in FIG. 6.

Referring to FIG. 8, the controller 30 of the image forming device 1 may output a first page sync signal PSS1 to the first image generation module 110, and the image processor 20 may output first image data IMD1 to the first image generation module 110.

In addition, the first image generation module 110 of the image forming device 1 may generate a yellow toner image, that is, a first toner image, on a surface of the transfer belt 151 according to the first page sync signal PSS1 of the controller 30 and the first image data IMD1 of the image processor 20.

In more detail, the first charging roller 112 may charge the outer circumferential surface of the first photosensitive drum 111, and the first exposure device 113 may emit light to the outer circumferential surface of the first photosensitive drum 111 according to the first image data IMD1 of the image processor 20. As a result, an electrostatic latent image corresponding to the first image data IMD1 is generated on the outer circumferential surface of the first photosensitive drum 111.

In addition, the first developing roller 114 develops the electrostatic latent image formed on the outer circumferential surface of the first photosensitive drum 111 by using yellow toner. As a result, a yellow toner image corresponding to the first image data IMD1, that is, a first toner image I1, is generated on the outer circumferential surface of the first photosensitive drum 111.

In addition, the first primary transfer roller 152*a* may transfer the first toner image I1 formed on the outer circumferential surface of the first photosensitive drum 111 to the transfer belt 151 by electrostatic attraction. As a result, the first toner image I1 is formed on the transfer belt 151.

As described above, the first image generation module 110 may form the first toner image I1 on a surface of the transfer belt 151 via a charging operation, an exposure operation, a developing operation, and a transferring operation.

The image forming device 1 generates a second toner image I2 in operation 1030.

The second image generation module 120 included in the image forming device 1 may generate a second toner image I2.

Figure 9:
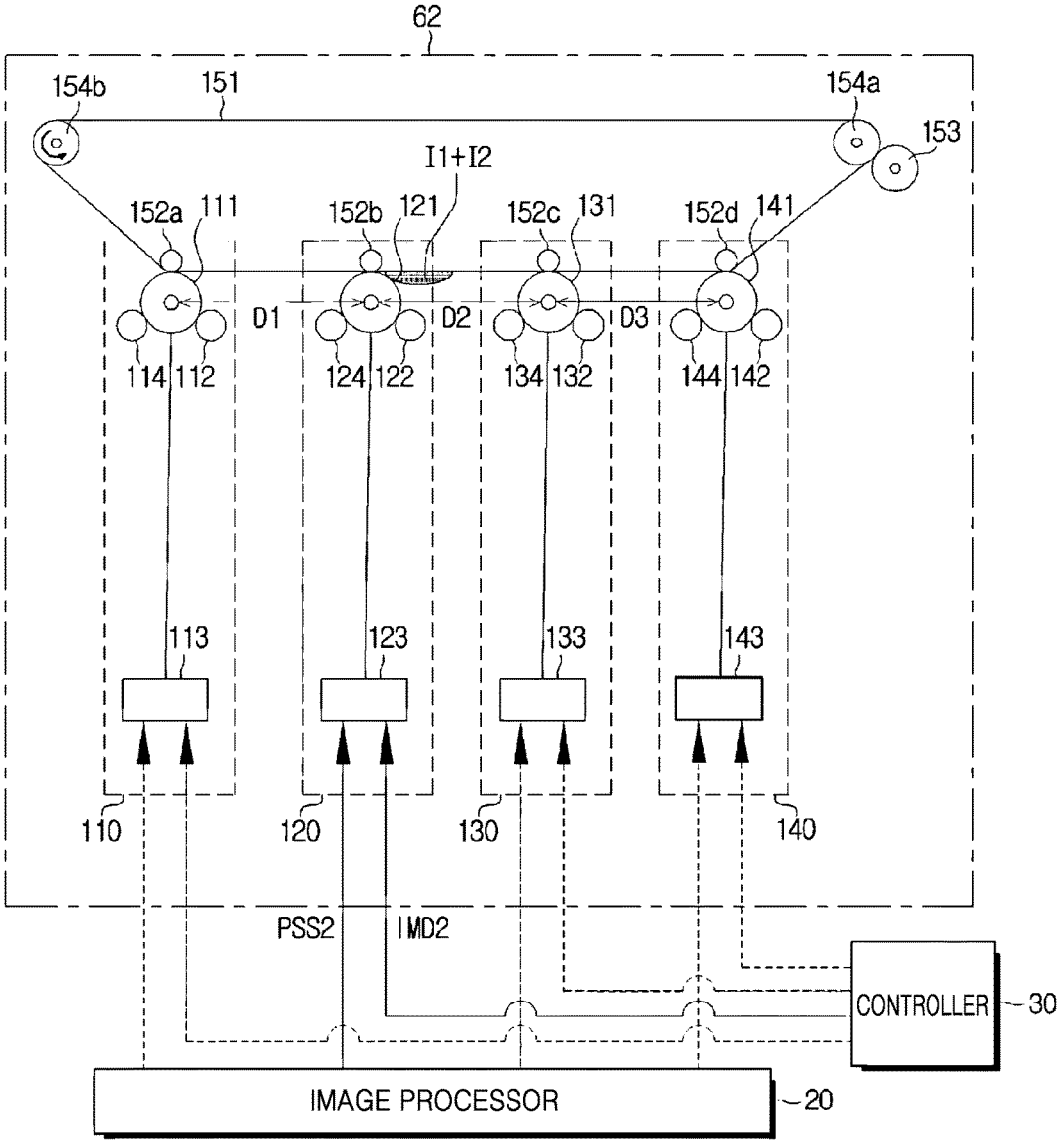

Referring to FIG. 9, the controller 30 of the image forming device 1 may output a second page sync signal PSS2 to the second image generation module 120, and the image processor 20 may output second image data IMD2 to the second image generation module 120.

A first time interval between a point when the controller 30 outputs a first page sync signal PSS1 and a point when the controller 30 outputs a second page sync signal PSS2 may be determined such that the first toner image I1 generated using the first image generation module 110 and the second toner image I2 generated using the second image generation module 120 overlap each other.

As described above, the image forming device 1 may sequentially generate a plurality of basic color toner images, and mix the plurality of basic color toner images to generate a color image. Accordingly, a time when the plurality of basic color toner images are generated may be adjusted such that the plurality of basic color toner images are generated at identical positions.

In other words, the second image generation module 120 may be on standby until the first toner image I1 is located near the second photosensitive drum 121 after the first toner image I1 is generated on the transfer belt 151. When the first toner image I1 on the transfer belt 151 is located on the second photosensitive drum 121, the second image generation module 120 may generate a second toner image I2 on the transfer belt 151 on the second photosensitive drum 121.

Here, a period of time from when the first toner image I1 is generated on the transfer belt 151 until the second toner image I2 is generated on the transfer belt 151, that is, the first time interval, may be determined based on a moving speed of the transfer belt 151 and a distance D1 between the first photosensitive drum 111 and the second photosensitive drum 121.

As described above, when the first time interval passes after the first image generation module 110 generated the first toner image I1, the second image generation module 120 may generate a magenta toner image, that is, a second toner image I2, on a surface of the transfer belt 151 according to the second page sync signal PSS2 of the controller 30.

In more detail, the second charging roller 122 may charge the outer circumferential surface of the second photosensitive drum 121, and the second exposure device 123 may emit light to the outer circumferential surface of the second photosensitive drum 121 according to the second image data IMD2 of the image processor 20. As a result, an electrostatic latent image corresponding to the second image data IMD2 is generated on the outer circumferential surface of the second photosensitive drum 121.

In addition, the second developing roller 124 develops the electrostatic latent image formed on the outer circumferential surface of the second photosensitive drum 121 by using magenta toner. As a result, a magenta toner image corresponding to the second image data IMD2, that is, a second toner image I2, is generated on the outer circumferential surface of the second photosensitive drum 121.

In addition, the second primary transfer roller 152*b* may transfer the second toner image I2 formed on the outer circumferential surface of the second photosensitive drum 121 to the transfer belt 151 by electrostatic attraction. As a result, the second toner image I2 is formed on the transfer belt 151.

As described above, the second image generation module 120 may generate the second toner image I2 on a surface of the transfer belt 151 via a charging operation, an exposure operation, a developing operation, and a transferring operation.

In addition, the second toner image I2 may overlap with the first toner image I1 as illustrated in FIG. 9.

The image forming device 1 generates a third toner image I3 in operation 1040.

The third image generation module 130 included in the image forming device 1 may generate a third toner image I3.

Figure 10:
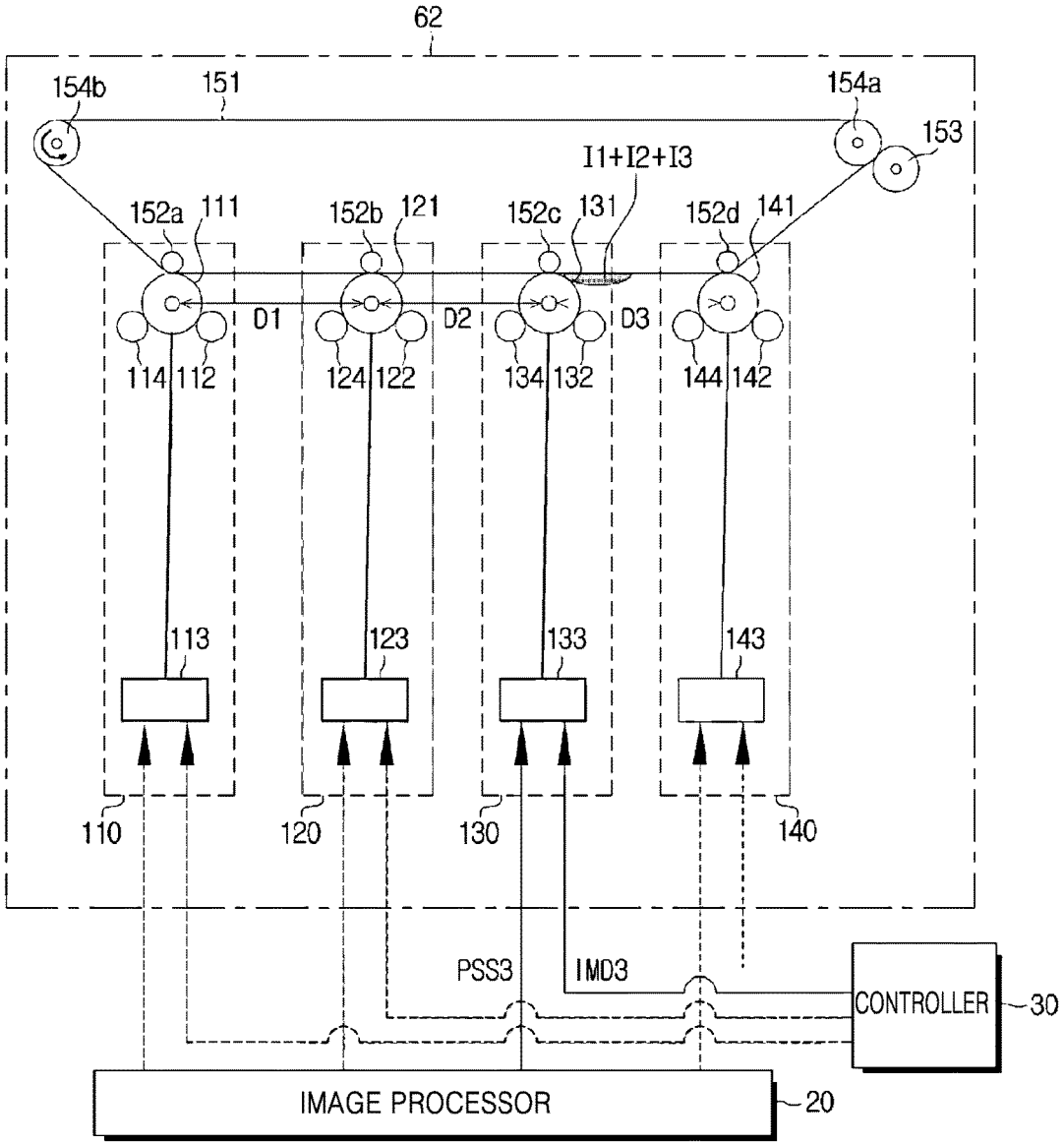

Referring to FIG. 10, the controller 30 of the image forming device 1 may output a third page sync signal PSS3 to the third image generation module 130, and the image processor 20 may output third image data IMD3 to the third image generation module 130.

A second time interval between a point when the controller 30 outputs a second page sync signal PSS2 and a point when the controller 30 outputs a third page sync signal PSS3 may be determined such that the second toner image I2 generated using the second image generation module 120 and the third toner image I3 generated using the third image generation module 130 overlap each other. In other words, in order that the second toner image I2 and the third toner image I3 overlap each other, the third image generation module 130 may be on standby until the second toner image I2 is located near the third photosensitive drum 131 after the second toner image I2 is generated on the transfer belt 151.

Here, a period from when the second toner image I2 is generated on the transfer belt 151 until the third toner image I3 is generated on the transfer belt 151, that is, the second time interval, may be determined based on a moving speed of the transfer belt 151 and a distance D2 between the second photosensitive drum 121 and the third photosensitive drum 131.

As described above, when the second time interval passes after the second image generation module 120 generated the second toner image I2, the third image generation module 130 may generate a cyan toner image, that is, a third toner image I3, on a surface of the transfer belt 151 according to the third page sync signal PSS3 of the controller 30.

In more detail, the third charging roller 132 may charge the outer circumferential surface of the third photosensitive drum 131, and the third exposure device 133 may emit light to the outer circumferential surface of the third photosensitive drum 131 according to the third image data IMD3 of the image processor 20. As a result, an electrostatic latent image corresponding to the third image data IMD3 is generated on the outer circumferential surface of the third photosensitive drum 131.

In addition, the third developing roller 134 may develop the electrostatic latent image formed on the outer circumferential surface of the third photosensitive drum 131 by using cyan toner. As a result, a cyan toner image corresponding to the third image data IMD3, that is, a third toner image I3, is generated on the outer circumferential surface of the third photosensitive drum 131.

In addition, the third primary transfer roller 152*c* may transfer the third toner image I3 formed on the outer circumferential surface of the third photosensitive drum 131 to the transfer belt 151 by electrostatic attraction. As a result, the third toner image I3 is formed on the transfer belt 151.

As described above, the third image generation module 130 may generate the third toner image I3 on a surface of the transfer belt 151 via a charging operation, an exposure operation, a developing operation, and a transferring operation.

In addition, the third toner image I3 may overlap with the first toner image I1 and the second toner image I2 as illustrated in FIG. 10.

The image forming device 1 generates a fourth toner image I4 in operation 1050.

The fourth image generation module 140 included in the image forming device 1 may generate a fourth toner image.

Figure 11:
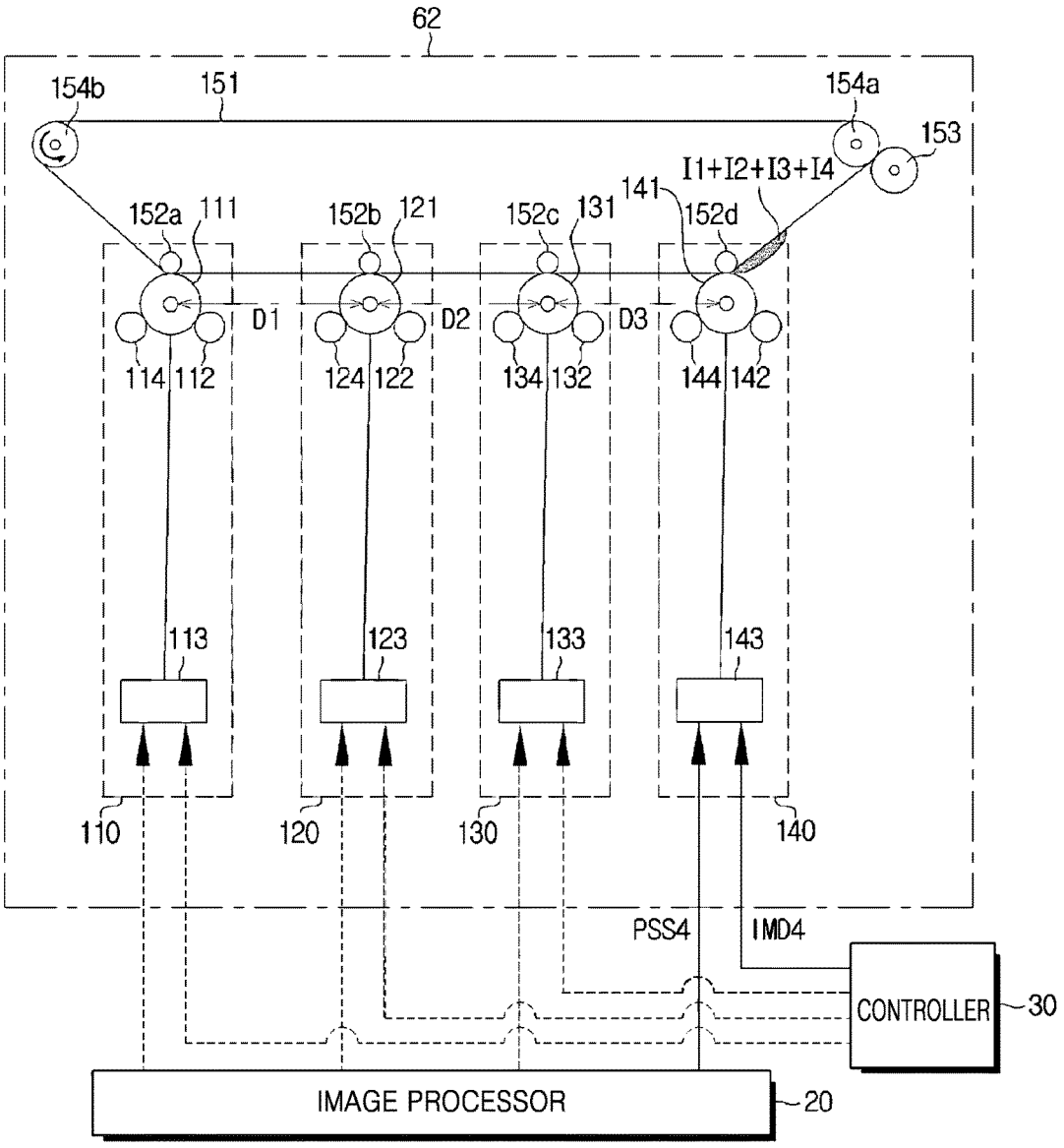

Referring to FIG. 11, the controller 30 of the image forming device 1 may output a fourth page sync signal PSS4 to the fourth image generation module 140, and the image processor 20 may output fourth image data IMD4 to the fourth image generation module 140.

A third time interval between a point when the controller 30 outputs a third page sync signal PSS3 and a point when the controller 30 outputs a fourth page sync signal PSS4 may be determined such that the third toner image I3 generated using the third image generation module 130 and the fourth toner image I4 generated using the fourth image generation module 140 overlap each other. In other words, in order that the third toner image I3 and the fourth toner image I4 overlap each other, the fourth image generation module 140 may be on standby until the third toner image I3 is located near the fourth photosensitive drum 141 after the third toner image I3 is generated on the transfer belt 151.

Here, a period from when the third toner image I3 is generated on the transfer belt 151 until the fourth toner image I4 is generated on the transfer belt 151, that is, the third time interval, may be determined based on a moving speed of the transfer belt 151 and a distance D3 between the third photosensitive drum 131 and the fourth photosensitive drum 141.

As described above, when the third time interval passes after the third image generation module 130 generated the third toner image I3, the fourth image generation module 140 may generate a cyan toner image, that is, a fourth toner image, on a surface of the transfer belt 151 according to the fourth page sync signal PSS4 of the controller 30.

In more detail, the fourth charging roller 142 may charge the outer circumferential surface of the fourth photosensitive drum 141, and the fourth exposure device 143 may emit light to the outer circumferential surface of the fourth photosensitive drum 141 according to the fourth image data IMD4 of the image processor 20. As a result, an electrostatic latent image corresponding to the fourth image data IMD4 is generated on the outer circumferential surface of the fourth photosensitive drum 141.

In addition, the fourth developing roller 144 develops the electrostatic latent image formed on the outer circumferential surface of the fourth photosensitive drum 141 by using black toner. As a result, a black toner image corresponding to the fourth image data IMD4, that is, the fourth toner image I4, is generated on the outer circumferential surface of the fourth photosensitive drum 141.

In addition, the fourth primary transfer roller 152*d* may transfer the fourth toner image I4 formed on the outer circumferential surface of the fourth photosensitive drum 141 to the transfer belt 151 by electrostatic attraction. As a result, the fourth toner image I4 is formed on the transfer belt 151.

As described above, the fourth image generation module 140 may form the fourth toner image I4 on a surface of the transfer belt 151 via a charging operation, an exposure operation, a developing operation, and a transferring operation.

In addition, the fourth toner image I4 may overlap with the first toner image I1, the second toner image I2, and the third toner image I3 as illustrated in FIG. 11.

The image forming device 1 transfers a color image to a printing medium P in operation 1060.

As described above, the first toner image I1, the second toner image I2, the third toner image I3, and the fourth toner image I4 may overlap each other on the transfer belt 151, and a final color image may be generated using the first toner image I1, the second toner image I2, the third toner image I3, and the fourth toner image I4.

In other words, as a yellow image, a magenta image, a cyan image, and a black image are mixed, a color image may be generated.

The secondary transfer roller 153 of the image forming device 1 may transfer the color toner image of the transfer belt 151 to a printing medium P.

The image forming device 1 fixes the color image transferred to the printing medium P in operation 1070.

The color image transferred to the printing medium P by using the secondary transfer roller 153 is attached to the printing medium P only by electrostatic attraction. Thus, the color image may be easily separated from the printing medium P by an external force or static electricity or the like. To prevent this, the fixing module 63 of the image forming device 1 may fix a color image to the printing medium P by using heat and pressure.

As described above, the image forming device 1 may sequentially generate first, second, third, and fourth toner images to generate a color toner image. In more detail, the controller 30 and the image processor 20 may sequentially provide first, second, third, and fourth page sync signals and first, second, third, and fourth image data to the image forming module 62, respectively.

Hereinafter, a method of adjusting a concentration of a plurality of toner images by using the image forming device 1 will be described.

Figure 12:
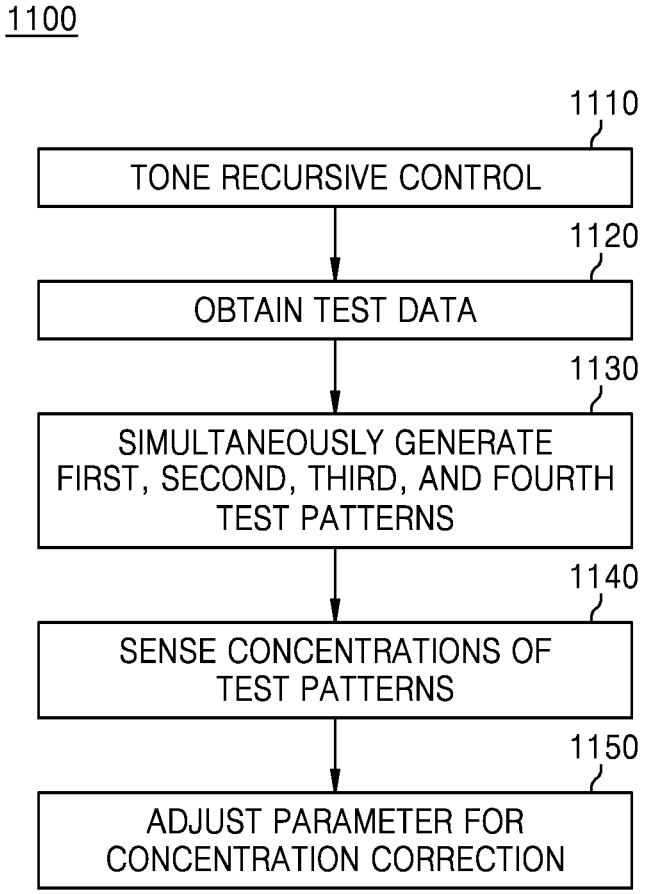
FIG. 12 illustrates a tone recursive control method of an image forming device according to an example.
Figure 13:
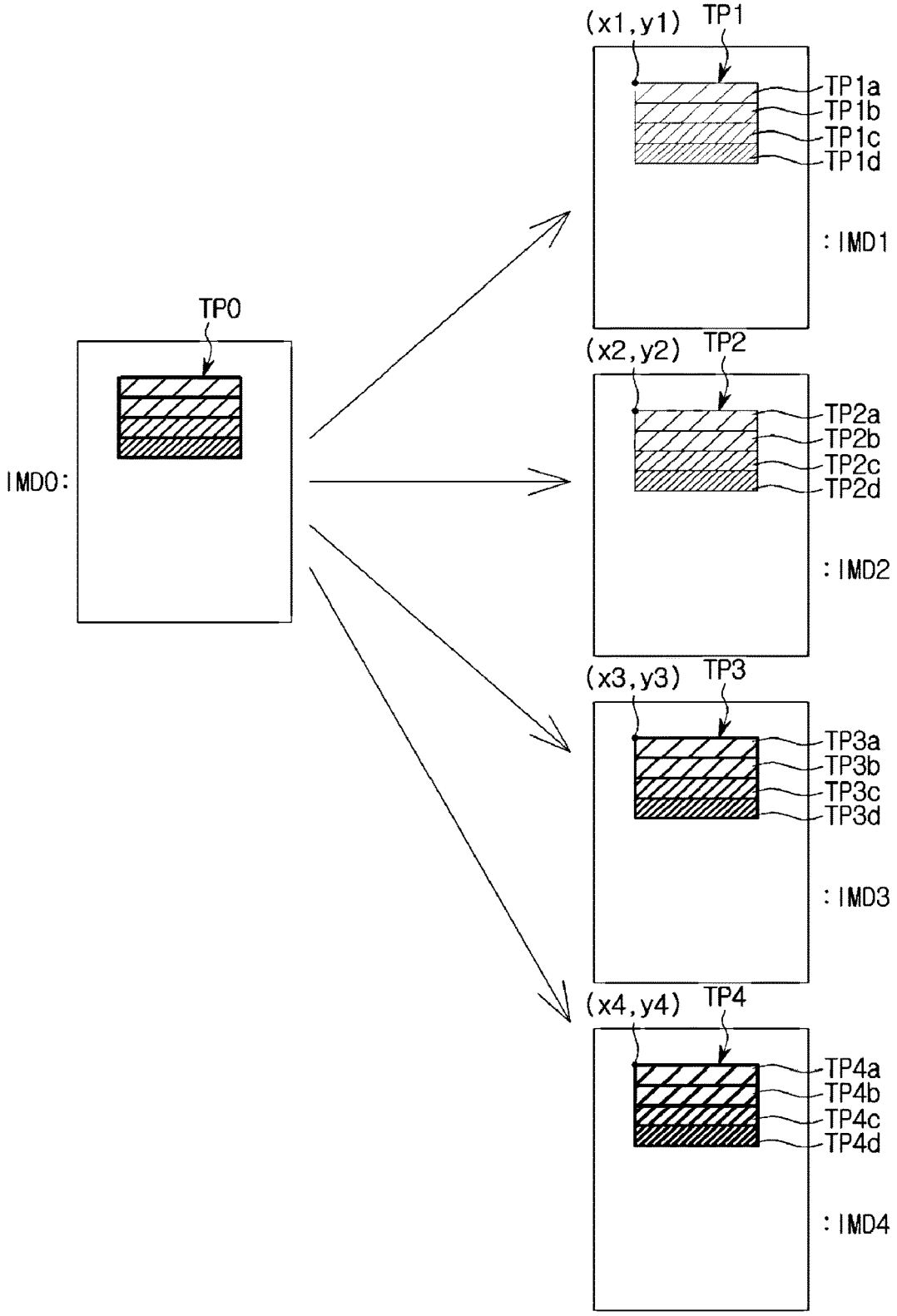
FIG. 13 illustrates obtaining of a test pattern according to the tone recursive control method illustrated in FIG. 12.
Figure 14:
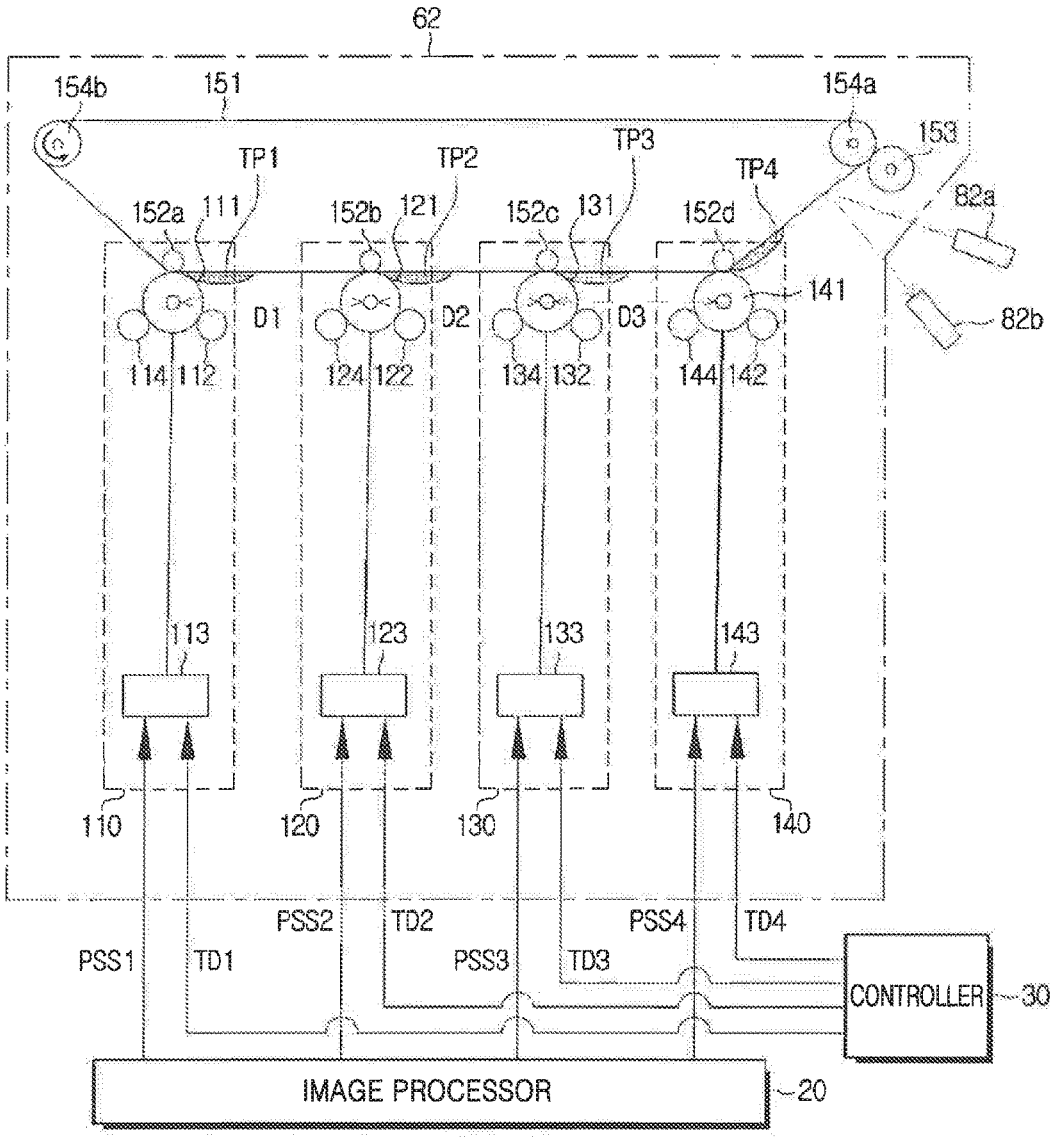
FIG. 14 illustrates generation of a test pattern according to the tone recursive control method illustrated in FIG. 12.
Figure 15:
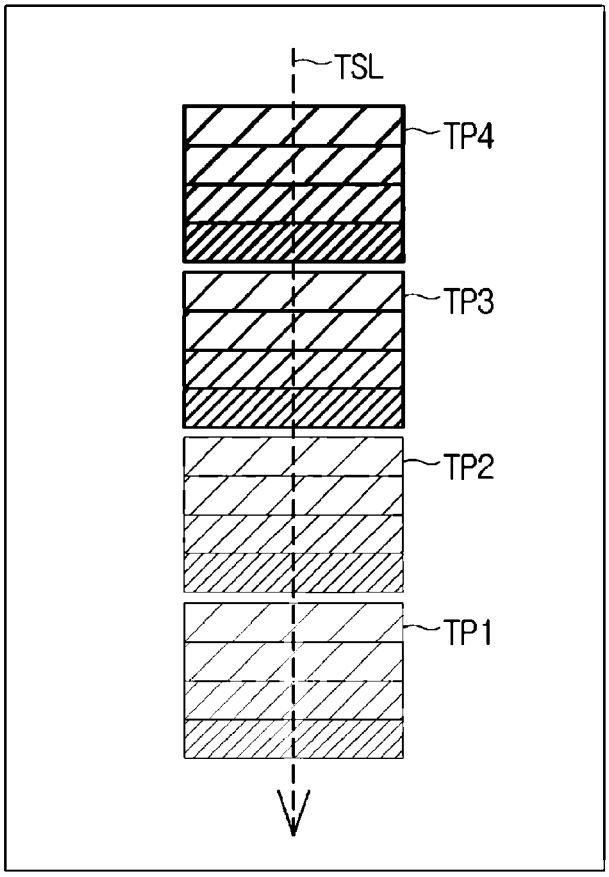
FIG. 15 illustrates an example of a test pattern generated according to the tone recursive control method illustrated in FIG. 12.

FIG. 12 illustrates a tone recursive control method of an image forming device according to an example. FIG. 13 illustrates obtaining of a test pattern according to the tone recursive control method illustrated in FIG. 12, and FIG. 14 illustrates generation of a test pattern according to the tone recursive control method illustrated in FIG. 12. In addition, FIG. 15 illustrates an example of a test pattern generated according to the tone recursive control method illustrated in FIG. 12.

A tone recursive control method 1100 of the image forming device 1 will be described with reference to FIGS. 12 through 15.

Referring to FIG. 12, when preset conditions are met, the image forming device 1 starts tone recursive control in operation 1110.

The image forming device 1 may perform tone recursive control under various conditions.

For example, when external power is supplied to the image forming device 1 after the supply of external power is cut off or when the developing devices (e.g., a cartridge) described above are replaced, the image forming device 1 may perform tone recursive control.

In addition, if the number of sheets of printing medium P on which the image forming device 1 has formed an image is equal to or greater than a predetermined reference number, or a period of a nonperformance time, during which the image forming device 1 does not perform image formation, is equal to or longer than a preset reference nonperformance time, the image forming device 1 may perform tone recursive control.

The image forming device 1 may also perform tone recursive control according to the user's control command.

Further, the image forming device 1 may perform preparation operations for image formation prior to tone recursive control. For example, the image forming device 1 may preheat the fixing module 63 included in the image forming unit 60, and drive laser scanners included in the first, second, third, and fourth exposure devices 113, 123, 133, and 143 in advance.

The image forming device 1 obtains test data TD0 (TD1, TD2, TD3, TD4) representing test patterns TP1, TP2, TP3, and TP4 for tone recursive control in operation 1120.

The test data TD0 (TD1, TD2, TD3, TD4) for tone recursive control may be stored in the storage unit 50 of the image forming device 1 in advance. Here, first test data TD1 represents a first test pattern TP1, second test data TD2 represents a second test pattern TP2, third test data TD3 represents a third test pattern TP3, and fourth test data TD4 represents a fourth test pattern TP4. Further, the first test pattern TP1 may be developed by yellow toner, the second test pattern TP2 may be developed by magenta toner, the third test pattern TP3 may be developed by cyan toner, and the fourth test pattern TP4 may be developed by black toner.

As described above, the storage unit 50 may store control programs and control data for controlling the image forming device 1. Here, the control data stored in the storage unit 50 may include test data TD0 for tone recursive control.

The controller 30 of the image forming device 1 may transmit the test data TD0 (TD1, TD2, TD3, TD4) stored in the storage unit 50 to the image processor 20.

Here, the test data TD0 (TD1, TD2, TD3, TD4) may be YMCK-type or RGB-type.

When RGB-type test data TD0 is stored in the storage unit 50, the image processor 20 may generate YMCK-type test data TD1, TD2, TD3, and TD4 from the RGB-type test data TD0 as illustrated in FIG. 13.

Each piece of the YMCK-type test data TD1, TD2, TD3, and TD4 may have the same shape.

For example, the first test pattern TP1 according to the first test data TD1 may include a plurality of test regions TP1*a*, TP1*b*, TP1*c*, and TP1*d* having different concentrations from each other. For example, as illustrated in FIG. 13, the first test pattern TP1 may include a first test region TP1*a* having a concentration of approximately 25% of a maximum concentration, a second test region TP1*b* having a concentration of approximately 50% of the maximum concentration, a third test region TP1*c* having a concentration of approximately 75% of the maximum concentration, and a fourth test region TP1*d* having the maximum concentration. In addition, the first test region TP1*a*, the second test region TP1*b*, the third test region TP1*c*, and the fourth test region TP1*d* may be arranged in order.

In addition, the second test pattern TP2 according to the second test data TD2 may include a plurality of test regions TP2*a*, TP2*b*, TP2*c*, and TP2*d* having different concentrations from each other, the third test pattern TP3 according to the third test data TD3 may include a plurality of test regions TP3*a*, TP3*b*, TP3*c* and TP3*d* having different concentrations from each other, and the fourth test pattern TP4 according to the fourth test data TD4 may include a plurality of test regions TP4*a*, TP4*b*, TP4*c*, and TP4*d* having different concentrations from each other.

While the first, second, third, and fourth test patterns TP1, TP2, TP3, and TP4 each include four test regions in FIG. 13, they are not limited thereto. For example, the first, second, third, and fourth test patterns TP1, TP2, TP3, and TP4 may each include three or less test regions or five or more test regions.

Also, the first, second, third, and fourth test patterns TP1, TP2, TP3, and TP4 may be disposed at same positions. In other words, coordinates (x1, y1) of an upper left end of the first test pattern TP1, coordinates (x2, y2) of an upper left end of the second test pattern TP2, coordinates (x3, y3) of an upper left end of the third test pattern TP3, and coordinates (x4, y4) of an upper left end of the fourth test pattern TP4 may be identical to each other.

Also, the first, second, third, and fourth test patterns TP1, TP2, TP3, and TP4 may have same sizes. In other words, a width w1 and a length d1 of the first test pattern TP1, a width w2 and a length d2 of the second test pattern TP2, a width w3 and a length d3 of the third test pattern TP3, and a width w4 and a length d4 of the fourth test pattern TP4 may be respectively equal to each other.

Here, the lengths d1, d2, d3, and d4 of the first, second, third, and fourth test patterns TP1, TP2, TP3, and TP4 may be identical to the distances D1, D2, and D3 between the photosensitive drums 111, 121, 131, and 141 or smaller than the distances D1, D2, and D3 between the photosensitive drums 111, 121, 131, and 141.

The image forming device 1 simultaneously generates the first, second, third, and fourth test patterns TP1, TP2, TP3, and TP4 in operation 1130.

The image forming device 1 may rotate the drive roller 154*a* to rotate the transfer belt 151 to generate test patterns. As a result, the photosensitive drums 111, 121, 131, and 141 and the transfer rollers 152*a*, 152*b*, 152*c*, and 152*d* that are in contact with the transfer belt 151 are rotated, and the charging rollers 112, 122, 132, and 142 and the developing rollers 114, 124, 134, and 144 that are in contact with the photosensitive drums 111, 121, 131, and 141 may be rotated.

However, since the test patterns TP1, TP2, TP3, and TP4 are not transferred to the printing medium P, the pick-up roller 61*a* and the transport roller 61*b* of the medium transporting module 61 may not be rotated.

In addition, the first, second, third, and fourth image generation modules 110, 120, 130, and 140 may simultaneously generate the first, second, third, and fourth test patterns TP1, TP2, TP3, and TP4.

In addition, as illustrated in FIG. 14, the controller 30 of the image forming device 1 may simultaneously output first, second, third, and fourth page sync signals PSS1, PSS2, PSS3, and PSS4 to the first, second, third, and fourth image generation modules 110, 120, 130, and 140. In addition, the controller 30 of the image forming device 1 may simultaneously output the first, second, third, and fourth test data TD1, TD2, TD3, and TD4 to the first, second, third, and fourth image generation modules 110, 120, 130, and 140 of the image forming device 1.

According to the above-described image forming method 1000 (see FIG. 8), in order for the image forming device 1 to generate a color image, the controller 30 sequentially outputs first, second, third, and fourth page sync signals PSS1, PSS2, PSS3, and PSS4 to the first, second, third, and fourth image generation modules 110, 120, 130, and 140. This is because the first, second, third, and fourth image generation modules 110, 120, 130, and 140 are spaced apart from each other by the preset distances D1, D2, and D3.

As a result, first, second, third, and fourth toner images are sequentially generated, and the first, second, third, and fourth toner images overlap each other, thereby generating one color toner image.

On the other hand, in the case of generation of the test patterns TP1, TP2, TP3 and TP4 for tone recursive control, the controller 30 simultaneously outputs first, second, third, and fourth page sync signals PSS1, PSS2, PSS3, and PSS4 to the first, second, third, and fourth image generation modules 110, 120, 130, and 140.

As a result, as illustrated in FIG. 14, the first, second, third, and fourth image generation modules 110, 120, 130, and 140 may simultaneously generate the first, second, third, and fourth test patterns TP1, TP2, TP3, and TP4.

In more detail, the first, second, third, and fourth exposure devices 113, 123, 133, and 143 may simultaneously emit light to the outer circumferential surface of the first, second, third, and fourth photosensitive drums 111, 121, 131, and 141. As a result, electrostatic latent images corresponding to the first, second, third, and fourth test data TD1, TD2, TD3, and TD4 are respectively generated on the outer circumferential surfaces of the first, second, third, and fourth photosensitive drums 111, 121, 131, and 141.

In addition, the first, second, third, and fourth developing rollers 114, 124, 134, and 144 develop the electrostatic latent images generated on the first, second, third, and fourth photosensitive drums 111, 121, 131, and 141 by using yellow toner, magenta toner, cyan toner, and black toner, respectively. As a result, the first, second, third, and fourth test patterns TP1, TP2, TP3, and TP4 are formed on the outer circumferential surfaces of the first, second, third, and fourth photosensitive drums 111, 121, 131, and 141, respectively.

In addition, the first, second, third, and fourth primary transfer rollers 152*a*, 152*b*, 152*c*, and 152*d* may transfer the first, second, third, and fourth test data patterns TP1, TP2, TP3, and TP4 formed on the outer circumferential surfaces of the first, second, third, and fourth photosensitive drums 111, 121, 131, and 141, to the transfer belt 151.

As a result, each of the first, second, third, and fourth test patterns TP1, TP2, TP3, and TP4 is formed on the transfer belt 151. Here, the first, second, third, and fourth test patterns TP1, TP2, TP3, and TP4 do not overlap each other as illustrated in FIG. 14.

As the first, second, third, and fourth image generation modules 110, 120, 130, and 140 are spaced apart from each other by the preset distances D1, D2, and D3, and the first, second, third, and fourth image generation modules 110, 120, 130, and 140 simultaneously generate the test patterns TP1, TP2, TP3, and TP4, the first, second, third, and fourth test patterns TP1, TP2, TP3, and TP4 are transferred to different locations on the transfer belt 151. In more detail, the first, second, third, and fourth test patterns TP1, TP2, TP3, and TP4 are formed on the transfer belt 151 by being spaced apart from each other by the distances D1, D2, and D3 of the first, second, third, and fourth image generation modules 110, 120, 130, and 140.

In addition, as described above, the lengths d1, d2, and d3 of the test patterns TP1, TP2, TP3, and TP4 are equal to or shorter than the distances D1, D2, and D3 of the first, second, third, and fourth image generation modules 110, 120, 130, and 140.

Accordingly, the first, second, third, and fourth test patterns TP1, TP2, TP3, and TP4 do not overlap each other. This is different from the image forming operation 1000 (see FIG. 6) in which the first, second, third, and fourth toner images I1, I2, I3, and I4 overlap each other.

The test patterns TP1, TP2, TP3, and TP4 formed on the transfer belt 151 by the test data TD1, TD2, TD3, and TD4 illustrated in FIG. 13 are as illustrated in FIG. 15.

When comparing the test data TD1, TD2, TD3, and TD4 illustrated in FIG. 13 with the test patterns TP1, TP2, TP3, and TP4 illustrated in FIG. 15, while the first, second, third, and fourth test patterns TP1, TP2, TP3, and TP4 according to the test data TD1, TD2, TD3, and TD4 overlap each other, the first, second, third, and fourth test patterns TP1, TP2, TP3, and TP4 formed on the transfer belt 151 are arranged in parallel with each other.

For example, the first, second, third, and fourth test patterns TP1, TP2, TP3, and TP4 are arranged, from top to bottom, in an order of the fourth test pattern TP4, the third test pattern TP3, the second test pattern TP2, and the first test pattern TP1.

This is because, as illustrated in FIG. 14, the first, second, third, and fourth image generation modules 110, 120, 130, and 140 are arranged in an order of the first image generation module 110, the second image generation module 120, the third image generation module 130, and the fourth image generation module 140 with respect to a moving direction of the transfer belt 151, and the first, second, third, and fourth image generation modules 110, 120, 130, and 140 simultaneously generate the test patterns TP1, TP2, TP3, and TP4.

As described above, the first, second, third, and fourth test patterns TP1, TP2, TP3, and TP4 are simultaneously generated, and the first, second, third, and fourth test patterns TP1, TP2, TP3, and TP4 may be arranged on the transfer belt 151 in an order of the fourth test pattern TP4, the third test pattern TP3, the second test pattern TP2, and the first test pattern TP1.

The image forming device 1 senses concentrations of the test patterns TP1, TP2, TP3, and TP4 in operation 1140.

The image forming device 1 may sense the concentrations of the test patterns TP1, TP2, TP3, and TP4 by using the first sensing module 81 included in the sensor 80.

In more detail, when tone recursive control is started or when generation of the test patterns TP1, TP2, TP3, and TP4 is completed, the controller 30 may output a control signal such that the first sensing module 81 senses the concentrations of the test patterns TP1, TP2, TP3, and TP4.

According to the control signal of the controller 30, the first light-emitting element 81*a* of the first sensing module 81 may emit light towards the transfer belt 151 on which the test patterns TP1, TP2, TP3, and TP4 are formed.

The light emitted toward the transfer belt 151 is reflected by a surface of the transfer belt 151. Here, according to the concentrations of the test patterns TP1, TP2, TP3, and TP4 formed on the surface of the transfer belt 151, intensity of light reflected by the surface of the transfer belt 151 may be varied. For example, the higher the concentrations of the test patterns TP1, TP2, TP3, and TP4, the lower may be the intensity of the light reflected by the surface of the transfer belt 151; the lower the concentrations of the test patterns TP1, TP2, TP3, and TP4, the higher may be the intensity of the light reflected by the surface of the transfer belt 151.

The first light-receiving element 81*b* of the first sensing module 81 may receive the light reflected by the surface of the transfer belt 151, and output concentration information corresponding to an intensity of the received light to the controller 30.

The controller 30 may determine concentrations of the test patterns TP1, TP2, TP3, and TP4 formed on the surface of the transfer belt 151 based on the concentration information received from the first light-receiving element 81*b*.

In addition, as the transfer belt 151 is moved, the first sensing module 81 may sequentially sense the concentrations of the first, second, third, and fourth test patterns TP1, TP2, TP3, and TP4, and may sequentially output concentration information corresponding to the sensed concentrations.

In more detail, while the transfer belt 151 is being moved, the first light-emitting element 81*a* may sequentially emit light to the first, second, third, and fourth test patterns TP1, TP2, TP3, and TP4 formed on the transfer belt 151. Here, locations where the emitted light arrives may form a tone sensing line (TSL) as illustrated in FIG. 15, and the TSL may pass through the first, second, third, and fourth test patterns TP1, TP2, TP3, and TP4.

In addition, the first light-receiving element 81*b* may sequentially receive light reflected by the first, second, third, and fourth test patterns TP1, TP2, TP3, and TP4, and may sequentially output concentration information corresponding to intensity of the received light.

The controller 30 may determine concentrations of the first, second, third, and fourth test patterns TP1, TP2, TP3, and TP4 based on the concentration information received from the first light-receiving element 81*b*.

The image forming device 1 adjusts a parameter for concentration correction based on concentration information of the test patterns TP1, TP2, TP3, and TP4 in operation 1150.

As described above, the first sensing module 81 may output the concentration information corresponding to the intensity of the light reflected by the test patterns TP1, TP2, TP3, and TP4, to the controller 30.

In addition, the controller 30 compares the concentration information (e.g., sensed intensity of reflected light) received from the first sensing module 81 for concentration correction of a toner image with reference concentration information (e.g., reference intensity of reflected light) that is previously stored in the storage unit 50.

For example, the controller 30 may compare an intensity of light reflected by the fourth test pattern TP4 which is a black color, with a reference intensity of reflected light according to a black toner image. In more detail, the controller 30 may compare a sensed intensity of light reflected by the first test region TP4*a* with a reference intensity of reflected light according to a black toner image having a concentration of 25% of a maximum concentration, a sensed intensity of light reflected by the second test region TP4*b* with a reference intensity of reflected light according to a black toner image having a concentration of 50% of the maximum concentration, a sensed intensity of light reflected by the third test region TP4*c* with a reference intensity of reflected light according to a black toner image having a concentration of 75% of the maximum concentration, and a sensed intensity of light reflected by the fourth test region TP4*d* with a reference intensity of reflected light according to a black toner image having the maximum concentration.

In the same manner, the controller 30 may compare a sensed intensity of light reflected by the third, second, and first test patterns TP3, TP2, and TP1 with reference intensities of reflected light according to cyan/magenta/yellow toner images.

In addition, the controller 30 may adjust a parameter for concentration correction based on a result of comparing sensed concentration information (e.g., sensed intensity of reflected light) of the test patterns TP1, TP2, TP3, and TP4 sensed using the first sensing module 81 and reference concentration information (e.g., reference intensity of reflected light) stored in the storage unit 50.

For example, when a sensed intensity of reflected light according to the fourth test pattern TP4 is less than a reference intensity of reflected light according to a black toner image (e.g., when a concentration of the fourth test pattern TP4 is higher than a reference concentration of black toner), the controller 30 may adjust a parameter of the fourth image generation module 140 such that an amount of black toner adhered to the fourth photosensitive drum 141 is reduced. In more detail, the controller 30 may control at least one of a magnitude of a voltage applied to the fourth charging roller 142, an intensity of light emitted by the fourth exposure device 143, and a magnitude of a voltage applied to the fourth developing roller 144. For example, the controller 30 may reduce a magnitude of a voltage applied to the fourth charging roller 142, reduce an intensity of light emitted by the fourth exposure device 143, and reduce a magnitude of a voltage applied to the fourth developing roller 144.

As another example, when a sensed intensity of reflected light according to the first test pattern TP1 is greater than a reference intensity of reflected light according to a yellow toner image (e.g., when a sensed concentration of the first test pattern TP1 is lower than a reference concentration of yellow), the controller 30 may adjust a parameter of the first image generation module 110 such that an amount of yellow toner adhered to the first photosensitive drum 111 is reduced. In more detail, the controller 30 may control at least one of a magnitude of a voltage applied to the first charging roller 112, an intensity of light emitted by the first exposure device 113, and a magnitude of a voltage applied to the first developing roller 114. For example, the controller 30 may increase a magnitude of a voltage applied to the first charging roller 112, increase an intensity of light emitted by the first exposure device 113, and increase a magnitude of a voltage applied to the first developing roller 114.

As described above, to form a color image according to the image data IMD1, IMD2, IMD3, and IMD4, the image forming device 1 sequentially generates first, second, third, and fourth toner images I1, I2, I3, and I4, whereas for concentration circulation control, the image forming device 1 may simultaneously generate the first, second, third, and fourth test patterns TP1, TP2, TP3, and TP4.

As a result, the first, second, third, and fourth test patterns TP1, TP2, TP3, and TP4 are simultaneously generated, and the first, second, third, and fourth test patterns TP1, TP2, TP3, and TP4 may be arranged on the transfer belt 151 in an order of the fourth test pattern TP4, the third test pattern TP3, the second test pattern TP2, and the first test pattern TP1. In addition, the first sensing module 81 may sense concentrations of the test patterns TP1, TP2, TP3, and TP4 in an order of the fourth test pattern TP4, the third test pattern TP3, the second test pattern TP2, and the first test pattern TP1.

Accordingly, a period of time for generating the test patterns TP1, TP2, TP3, and TP4 for concentration circulation control may be minimized, and a period of time for performing concentration circulation control may be minimized.

The example in which the first, second, third, and fourth image generation modules 110, 120, 130, and 140 simultaneously generate the first, second, third, and fourth test patterns TP1, TP2, TP3, and TP4, and transfer the generated first, second, third, and fourth test patterns TP1, TP2, TP3, and TP4 to the transfer belt 151 has been described above.

However, generation of test patterns for tone recursive correction is not limited to this. In other words, when the test patterns TP1, TP2, TP3, and TP4 are arranged in the same order as the arrangement order of the image generation modules 110, 120, 130, and 140, the test patterns TP1, TP2, TP3, and TP4 do not have to be formed necessarily at the same time.

For example, when the test patterns TP1, TP2, TP3, and TP4 are arranged in the same order as the arrangement order of the image generation modules 110, 120, 130, and 140, the controller 30 may control the first image generation module 110, the second image generation module 120, the third image generation module 130, and the fourth image generation module 140 such that they respectively sequentially generate test patterns TP1, TP2, TP3, and TP4.

In addition, when the test patterns TP1, TP2, TP3, and TP4 are arranged in the same order as the arrangement order of the image generation modules 110, 120, 130, and 140, the controller 30 may control the fourth image generation module 140, the third image generation module 130, the second image generation module 120, and the first image generation module 110 such that they respectively sequentially generate test patterns TP1, TP2, TP3, and TP4.

Hereinafter, a method of aligning a plurality of toner images by using the image forming device 1 will be described.

Figure 16:
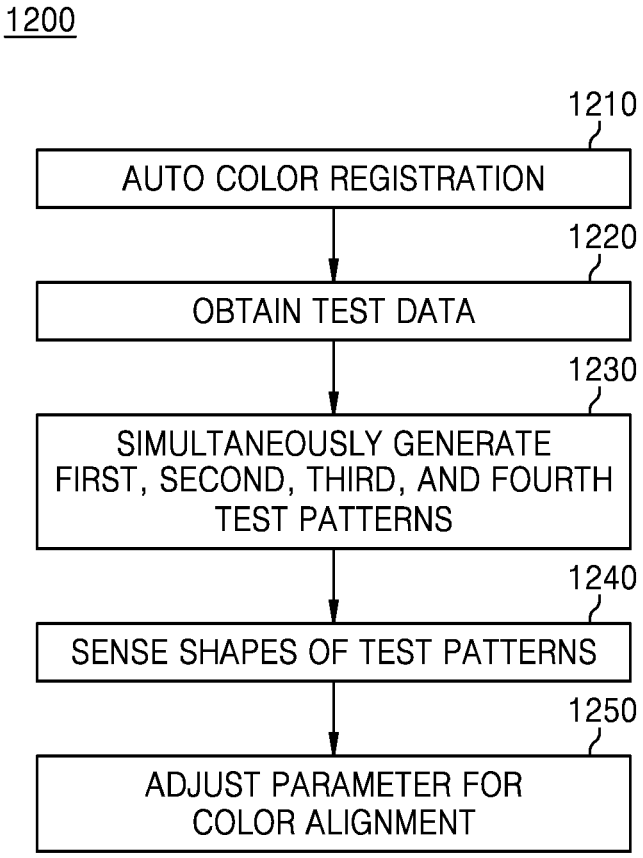
FIG. 16 illustrates an auto color registration method of an image forming device according to an example.
Figure 17:
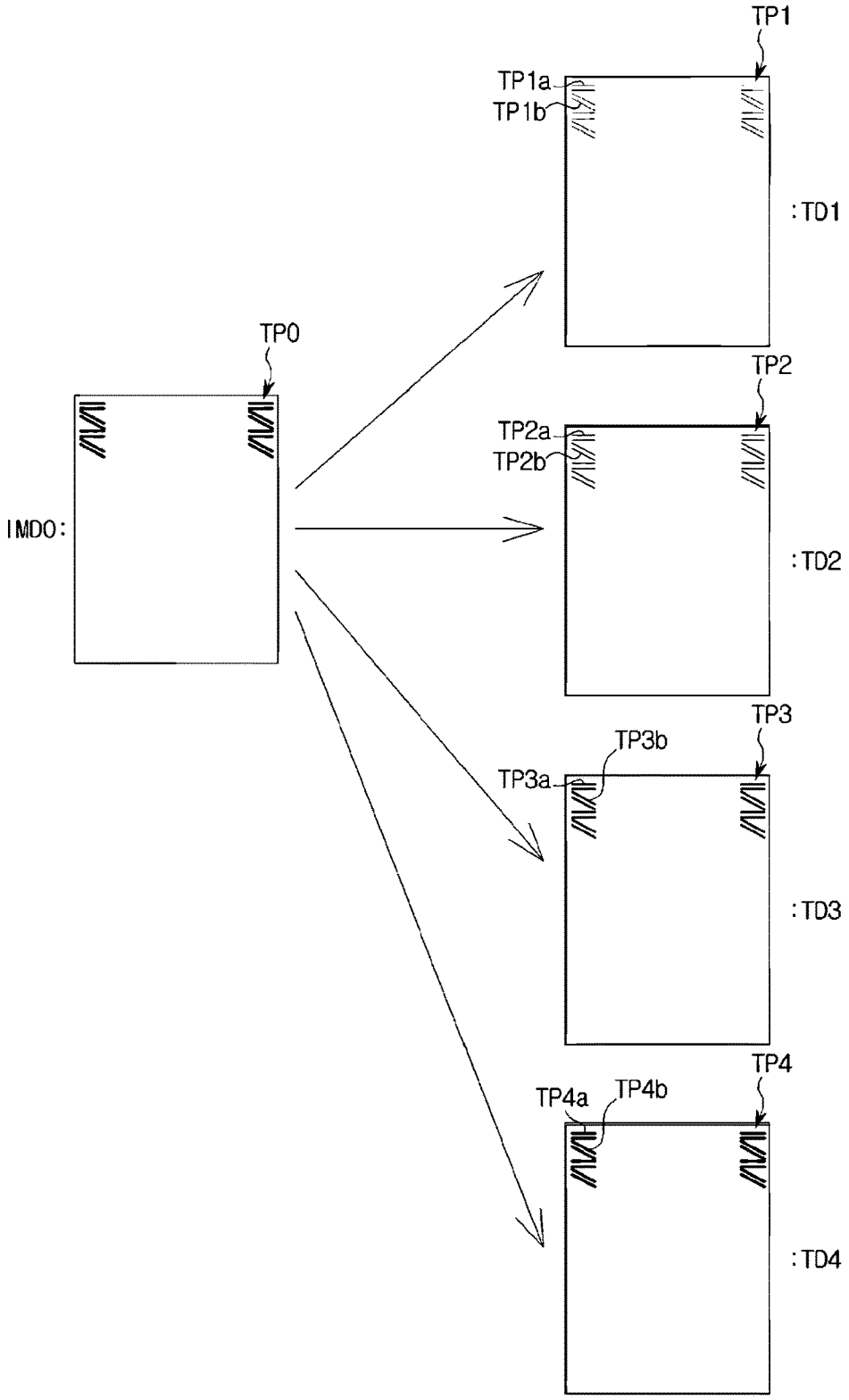
FIG. 17 illustrates obtaining of a test pattern according to the auto color registration method illustrated in FIG. 16.
Figure 18:
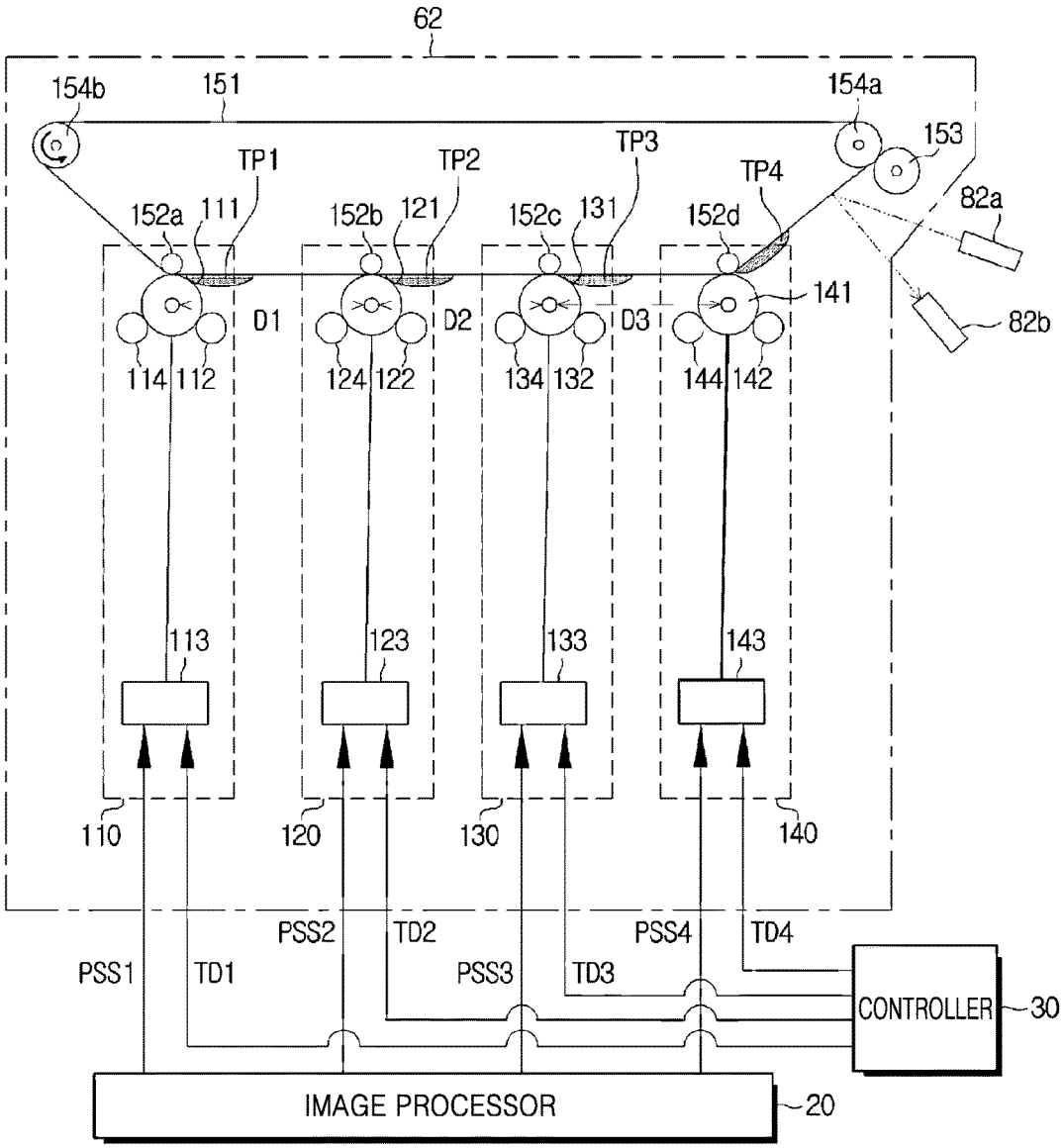
FIG. 18 illustrates generation of a test pattern according to the auto color registration method illustrated in FIG. 16.
Figure 19:
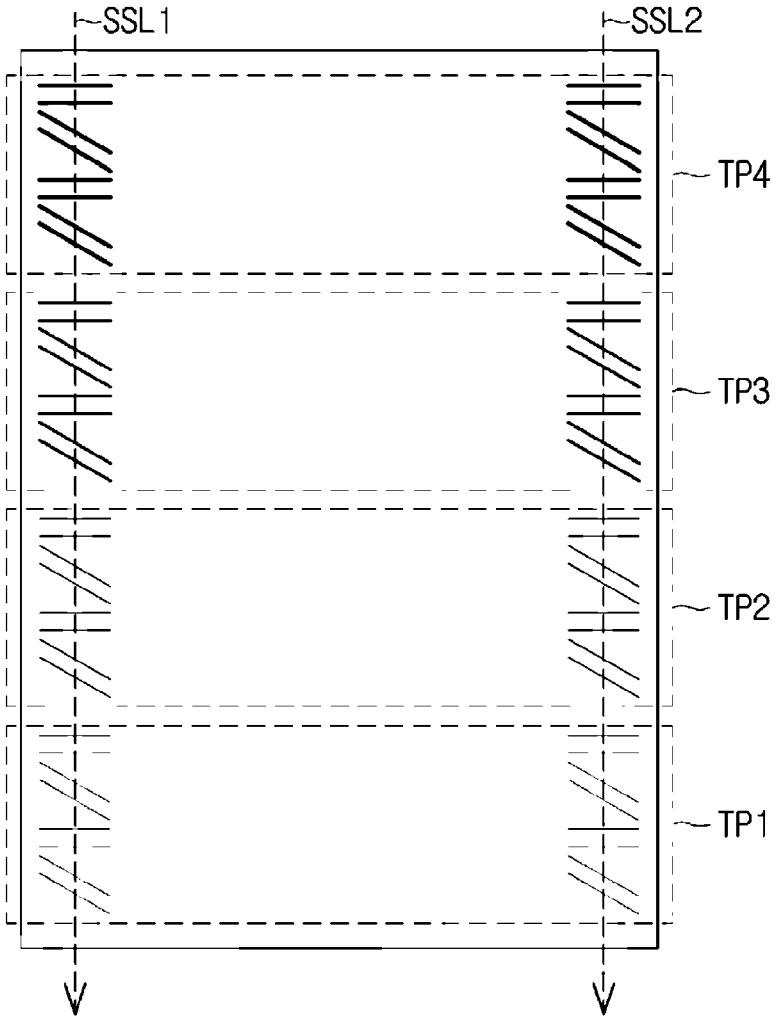
FIG. 19 illustrates an example of a test pattern generated according to the auto color registration method illustrated in FIG. 16.

FIG. 16 illustrates an auto color registration method of an image forming device according to an example. FIG. 17 illustrates obtaining of a test pattern according to the auto color registration method illustrated in FIG. 16, and FIG. 18 illustrates generation of a test pattern according to the auto color registration method illustrated in FIG. 16. Also, FIG. 19 illustrates an example of a test pattern generated according to the auto color registration method illustrated in FIG. 16.

An auto color registration method 1200 of the image forming device 1 will be described with reference to FIGS. 16 through 19.

Referring to FIG. 16, when preset conditions are met, the image forming device 1 starts auto color registration in operation 1210.

The image forming device 1 may perform auto color registration under various conditions.

For example, when external power is supplied to the image forming device 1 after the supply of external power is cut off or when the developing devices (e.g., a cartridge) described above are replaced, the image forming device 1 may perform auto color registration.

In addition, if the number of sheets of the printing medium P on which the image forming device 1 has formed an image is equal to or greater than a predetermined reference number, or a period of a nonperformance time during which the image forming device 1 does not perform image formation is equal to or longer than a preset reference nonperformance time, the image forming device 1 may perform auto color registration.

The image forming device 1 may also perform auto color registration according to the user's concentration control command.

Further, the image forming device 1 may perform preparation operations for image formation prior to auto color registration. For example, the image forming device 1 may preheat the fixing module 63 included in the image forming unit 60, and drive laser scanners included in the first, second, third, and fourth exposure devices 113, 123, 133, and 143 in advance.

The image forming device 1 obtains test data TD0 (TD1, TD2, TD3, TD4) representing test patterns TP1, TP2, TP3, and TP4 for auto color registration in operation 1220.

The test data TD0 (TD1, TD2, TD3, and TD4) for auto color registration may be stored in the storage unit 50 of the image forming device 1 in advance. Here, first test data TD1 represents a first test pattern TP1, second test data TD2 represents a second test pattern TP2, third test data TD3 represents a third test pattern TP3, and fourth test data TD4 represents a fourth test pattern TP4. Further, the first test pattern TP1 may be developed by yellow toner, the second test pattern TP2 may be developed by magenta toner, the third test pattern TP3 may be developed by cyan toner, and the fourth pattern TP4 may be developed by black toner.

The controller 30 of the image forming device 1 may transmit the test data TD0 (TD1, TD2, TD3, and TD4) stored in the storage unit 50 to the image processor 20.

Here, the test data TD0 (TD1, TD2, TD3, TD4) may be YMCK-type or RGB-type.

When RGB-type test data TD0 is stored in the storage unit 50, the image processor 20 may generate YMCK-type test data TD1, TD2, TD3, and TD4 from the RGB-type test data TD0 as illustrated in FIG. 17.

Each piece of the YMCK-type test data TD1, TD2, TD3, and TD4 may have the same shape.

For example, the first test pattern TP1 according to the first test data TD1 may include at least one horizontal bar TP1*a* and at least one slash bar TP1*b*. Also, the at least one horizontal bar TP1*a* and the at least one slash bar TP1*b* may be repeated, and the at least one horizontal bar TP1*a* and the at least one slash bar TP1*b* may be provided at two ends of the first test pattern TP1.

In addition, the second test pattern TP2 according to the second test data TD2 may include at least one horizontal bar TP2*a* and at least one slash bar TP2*b*, the third test pattern TP3 according to the third test data TD3 may include at least one horizontal bar TP3*a* and at least one slash bar TP3*b*, and the fourth test pattern TP4 according to the fourth test data TD4 may include at least one horizontal bar TP4*a* and at least one slash bar TP4*b*.

In FIG. 17, the first, second, third, and fourth test patterns TP1, TP2, TP3, and TP4 each include a pair of horizontal bars and a pair of slash bars, which are alternatively repeated, but they are not limited thereto. For example, the first, second, third, and fourth test patterns TP1, TP2, TP3, and TP4 may include one horizontal bar and one slash bar, or may include horizontal bars and slash bars that are alternatively repeated.

In addition, the first, second, third, and fourth test patterns TP1, TP2, TP3, and TP4 may be disposed at same positions, and the first, second, third, and fourth test patterns TP1, TP2, TP3, and TP4 may have same sizes.

The lengths d1, d2, d3, and d4 of the first, second, third, and fourth test patterns TP1, TP2, TP3, and TP4 may be identical to the distances D1, D2, and D3 between the photosensitive drums 111, 121, 131, and 141 or smaller than the distances D1, D2, and D3 between the photosensitive drums 111, 121, 131, and 141.

The image forming device 1 simultaneously generates the first, second, third, and fourth test patterns TP1, TP2, TP3, and TP4 in operation 1230.

The image forming device 1 may rotate the drive roller 154*a* to rotate the transfer belt 151 to generate test patterns. As a result, the photosensitive drums 111, 121, 131, and 141 and the transfer rollers 152*a*, 152*b*, 152*c*, and 152*d* that are in contact with the transfer belt 151 are rotated, and the charging rollers 112, 122, 132, and 142 and the developing rollers 114, 124, 134, and 144 that are in contact with the photosensitive drums 111, 121, 131, and 141 may be rotated.

However, since the test patterns TP1, TP2, TP3, and TP4 are not transferred to the printing medium P, the pick-up roller 61*a* and the transport roller 61*b* of the medium transporting module 61 may not be rotated.

In addition, the first, second, third, and fourth image generation modules 110, 120, 130, and 140 may simultaneously generate the first, second, third, and fourth test patterns TP1, TP2, TP3, and TP4.

In addition, as illustrated in FIG. 18, the controller 30 of the image forming device 1 may simultaneously output first, second, third, and fourth page sync signals PSS1, PSS2, PSS3, and PSS4 to the first, second, third, and fourth image generation modules 110, 120, 130, and 140. In addition, the controller 30 of the image forming device 1 may simultaneously output the first, second, third, and fourth test data TD1, TD2, TD3, and TD4 to the first, second, third, and fourth image generation modules 110, 120, 130, and 140 of the image forming device 1.

As a result, the first, second, third, and fourth image generation modules 110, 120, 130, and 140 may simultaneously generate the first, second, third, and fourth test patterns TP1, TP2, TP3, and TP4.

In more detail, the first, second, third, and fourth exposure devices 113, 123, 133, and 143 may simultaneously emit light to the outer circumferential surface of the first, second, third, and fourth photosensitive drums 111, 121, 131, and 141. As a result, electrostatic latent images corresponding to the first, second, third, and fourth test data TD1, TD2, TD3, and TD4 are respectively generated on the outer circumferential surfaces of the first, second, third, and fourth photosensitive drums 111, 121, 131, and 141.

In addition, the first, second, third, and fourth developing rollers 114, 124, 134, and 144 develop the electrostatic latent images generated on the first, second, third, and fourth photosensitive drums 111, 121, 131, and 141 by using yellow toner, magenta toner, cyan toner, and black toner, respectively. As a result, first, second, third, and fourth test patterns TP1, TP2, TP3, and TP4 are formed on the outer circumferential surfaces of the first, second, third, and fourth photosensitive drums 111, 121, 131, and 141, respectively.

In addition, the first, second, third, and fourth primary transfer rollers 152*a*, 152*b*, 152*c*, and 152*d* may transfer the first, second, third, and fourth test patterns TP1, TP2, TP3, and TP4 formed on the outer circumferential surfaces of the first, second, third, and fourth photosensitive drums 111, 121, 131, and 141, to the transfer belt 151.

As a result, each of the first, second, third, and fourth test patterns TP1, TP2, TP3, and TP4 is formed on the transfer belt 151. Here, the first, second, third, and fourth test patterns TP1, TP2, TP3, and TP4 do not overlap each other as illustrated in FIG. 18. This is different from the image forming operation 1000 (see FIG. 6) in which the first, second, third, and fourth toner images I1, I2, I3, and I4 overlap each other.

The test patterns TP1, TP2, TP3, and TP4 formed on the transfer belt 151 by the test data TD1, TD2, TD3, and TD4 illustrated in FIG. 17 are as illustrated in FIG. 19.

When comparing the test data TD1, TD2, TD3, and TD4 illustrated in FIG. 17 with the test patterns TP1, TP2, TP3, and TP4 illustrated in FIG. 19, the first, second, third, and fourth test patterns TP1, TP2, TP3, and TP4 overlap each other according to the test data TD1, TD2, TD3, and TD4, but the first, second, third, and fourth test patterns TP1, TP2, TP3, and TP4 formed on the transfer belt 151 are arranged in parallel with each other.

For example, the first, second, third, and fourth test patterns TP1, TP2, TP3, and TP4 are arranged, from top to bottom, in an order of the fourth test pattern TP4, the third test pattern TP3, the second test pattern TP2, and the first test pattern TP1.

This is because, as illustrated in FIG. 18, the first, second, third, and fourth image generation modules 110, 120, 130, and 140 are arranged in an order of the first image generation module 110, the second image generation module 120, the third image generation module 130, and the fourth image generation module 140 with respect to a moving direction of the transfer belt 151, and the first, second, third, and fourth image generation modules 110, 120, 130, and 140 simultaneously generate the test patterns TP1, TP2, TP3, and TP4.

As described above, generation of the first, second, third, and fourth test patterns TP1, TP2, TP3, and TP4 may be simultaneously started, and the generation thereof may be simultaneously completed. In addition, the first, second, third, and fourth test patterns TP1, TP2, TP3, and TP4 may be arranged on the transfer belt 151 in an order of the fourth test pattern TP4, the third test pattern TP3, the second test pattern TP2, and the first test pattern TP1.

The image forming device 1 senses shapes of the test patterns TP1, TP2, TP3, and TP4 in operation 1240.

The image forming device 1 may sense shapes of the test patterns TP1, TP2, TP3, and TP4 by using the second sensing module 82 included in the sensor 80.

In more detail, when auto color registration is started or when generation of the test patterns TP1, TP2, TP3, and TP4 is completed, the controller 30 may output a control signal such that the second sensing module 82 senses the shapes of the test patterns TP1, TP2, TP3, and TP4.

According to the control signal of the controller 30, the second light-emitting element 82*a* of the second sensing module 82 may emit light towards the transfer belt 151 on which the test patterns TP1, TP2, TP3, and TP4 are formed.

The light emitted toward the transfer belt 151 is reflected by a surface of the transfer belt 151. Here, according to the shapes of the test patterns TP1, TP2, TP3, and TP4 formed on the surface of the transfer belt 151, light may be reflected by the surface of the transfer belt 151 or not reflected. For example, when the transfer belt 151 is black, light may be reflected at locations where the test patterns TP1, TP2, TP3, and TP4 are formed, and light may not be reflected at locations where the test patterns TP1, TP2, TP3, and TP4 are not formed.

The second light-receiving element 82*b* of the second sensing module 82 may receive light reflected by the surface of the transfer belt 151, and may output shape information to the controller 30 according to reception of light.

In addition, as the transfer belt 151 is moved, the second sensing module 82 may sequentially sense shapes of the first, second, third, and fourth test patterns TP1, TP2, TP3, and TP4, and may sequentially output shape information corresponding to the sensed shape.

In more detail, while the transfer belt 151 is being moved, the second light-emitting element 82*a* may sequentially emit light to the first, second, third, and fourth test patterns TP1, TP2, TP3, and TP4 formed on the transfer belt 151. Here, locations where the emitted light arrives may form shape sensing lines SSL1 and SSL2 as illustrated in FIG. 19, and the shape sensing lines SSL1 and SSL2 may pass through the first, second, third, and fourth test patterns TP1, TP2, TP3, and TP4.

In addition, the second light-receiving element 82*b* may sequentially receive light reflected by the first, second, third, and fourth test patterns TP1, TP2, TP3, and TP4, and may sequentially output shape information corresponding to whether light is received or not.

The controller 30 may determine shapes of the test patterns TP1, TP2, TP3, and TP4 based on the shape information received from the second light-receiving element 82*b*. For example, the controller 30 may calculate a distance between the horizontal bars TP1*a*, TP2*a*, TP3*a*, and TP4*a* and a distance between the slash bars TP1*b*, TP2*b*, TP3*b*, and TP4*b* included in the first, second, third, and fourth test patterns TP1, TP2, TP3, and TP4.

The image forming device 1 adjusts a parameter for color registration based on the shapes of the test patterns TP1, TP2, TP3, and TP4 in operation 1250.

As described above, the controller 30 of the image forming device 1 may calculate, based on the shape information received from the second light-receiving element 82*b*, a distance between the plurality of horizontal bars TP1*a*, TP2*a*, TP3*a*, and TP4*a* and a distance between the slash bars TP1*b*, TP2*b*, TP3*b*, and TP4*b* included in the first, second, third, and fourth test patterns TP1, TP2, TP3, and TP4.

In addition, the controller 30 may align the first, second, third, and fourth toner images I1, I2, I3, and I4 generated using the first, second, third, and fourth image generation modules 110, 120, 130, and 140 in a y-axis direction based on the distance between the plurality of horizontal bars TP1*a*, TP2*a*, TP3*a*, and TP4*a*.

In more detail, the controller 30 may adjust a first time interval between a first page sync signal PSS1 and a second page sync signal PSS2 based on a distance between the horizontal bar TP1*a* of the first test pattern TP1 and the horizontal bar TP2*a* of the second test pattern TP2. As described above, in order for the first toner image I1 and the second toner image I2 to overlap each other, there is the first time interval between a time when the first page sync signal PSS1 is output and a time when the second page sync signal PSS2 is output.

Here, the controller 30 may align the first toner image I1 and the second toner image I2 by adjusting the first time interval. For example, when the distance between the horizontal bar TP1*a* of the first test pattern TP1 and the horizontal bar TP2*a* of the second test pattern TP2 is greater than a reference distance, the controller 30 may increase the first time interval, and when the distance between the horizontal bar TP1*a* of the first test pattern TP1 and the horizontal bar TP2*a* of the second test pattern TP2 is smaller than the reference distance, the controller 30 may reduce the first time interval.

By using this method, the controller 30 may adjust a second time interval between a second page sync signal PSS2 and a third page sync signal PSS3 based on a distance between the horizontal bar TP2*a* of the second test pattern TP2 and the horizontal bar TP3*a* of the third test pattern TP3, and may adjust a third time interval between a third page sync signal PSS3 and a fourth page sync signal PSS4 based on a distance between the horizontal bar TP3*a* of the third test pattern TP3 and the horizontal bar TP4*a* of the fourth test pattern TP4.

In addition, the controller 30 may align the first, second, third, and fourth toner images I1, I2, I3, and I4 generated using the first, second, third, and fourth image generation modules 110, 120, 130, and 140 in a x-axis direction based on the distance between the plurality of slash bars TP1*b*, TP2*b*, TP3*b*, and TP4*b*.

In more detail, the controller 30 may adjust a location of an electrostatic latent image generated on the outer circumferential surface of the second photosensitive drum 121 by using the second exposure device 123 based on a distance between the slash bar TP1*b* of the first test pattern TP1 and the slash bar TP2*b* of the second test pattern TP2.

In other words, the controller 30 may adjust a left margin and a right margin of a second toner image. For example, when the slash bars TP1*b*, TP2*b*, TP3*b*, and TP4*b* are bars having upper portions tilted to the left as illustrated in FIG. 19, and a distance between the slash bar TP1*b* of the first test pattern TP1 and the slash bar TP2*b* of the second test pattern TP2 is greater than a reference distance, the controller 30 may reduce the left margin of the second toner image and increase the right margin thereof. In addition, when the distance between the slash bar TP1*b* of the first test pattern TP1 and the slash bar TP2*b* of the second test pattern TP2 is smaller than the reference distance, the controller 30 may increase the left margin of the second toner image and reduce the right margin thereof.

By using this method, the controller 30 may adjust a left margin and a right margin of a third toner image based on a distance between the slash bar TP2*b* of the second test pattern TP2 and the slash bar TP3*b* of the third test pattern TP3, and may adjust a left margin and a right margin of a fourth toner image based on a distance between the slash bar TP3*b* of the third test pattern TP3 and the slash bar TP4*b* of the fourth test pattern TP4.

As described above, to form a color image according to the image data IMD1, IMD2, IMD3, and IMD4, the image forming device 1 may sequentially generate the first, second, third, and fourth toner images I1, I2, I3, and I4, whereas for auto color registration, the image forming device 1 may simultaneously generate the first, second, third, and fourth test patterns TP1, TP2, TP3, and TP4.

As a result, the first, second, third, and fourth test patterns TP1, TP2, TP3, and TP4 are simultaneously generated, and the first, second, third, and fourth test patterns TP1, TP2, TP3, and TP4 may be arranged on the transfer belt 151 in an order of the fourth test pattern TP4, the third test pattern TP3, the second test pattern TP2, and the first test pattern TP1. In addition, the second sensing module 82 may sense shapes of the test patterns TP1, TP2, TP3, and TP4 in an order of the fourth test pattern TP4, the third test pattern TP3, the second test pattern TP2, and the first test pattern TP1.

Accordingly, a period of time for generating the test patterns TP1, TP2, TP3, and TP4 for auto color registration may be minimized, and a period of time for performing auto color registration may be minimized.

The example in which the first, second, third, and fourth image generation modules 110, 120, 130, and 140 simultaneously generate the first, second, third, and fourth test patterns TP1, TP2, TP3, and TP4 and transfer the generated first, second, third, and fourth test patterns TP1, TP2, TP3, and TP4 to the transfer belt 151 is described above.

However, generation of test patterns for auto color registration is not limited to this. In other words, when the test patterns TP1, TP2, TP3, and TP4 are arranged in the same order as the arrangement order of the image generation modules 110, 120, 130, and 140, the test patterns TP1, TP2, TP3, and TP4 do not have to be formed necessarily at the same time.

For example, when the test patterns TP1, TP2, TP3, and TP4 are arranged in the same order as the arrangement order of the image generation modules 110, 120, 130, and 140, the controller 30 may control the first image generation module 110, the second image generation module 120, the third image generation module 130, and the fourth image generation module 140 such that they respectively sequentially generate test patterns TP1, TP2, TP3, and TP4.

In addition, when the test patterns TP1, TP2, TP3, and TP4 are arranged in the same order as the arrangement order of the image generation modules 110, 120, 130, and 140, the controller 30 may control the fourth image generation module 140, the third image generation module 130, the second image generation module 120, and the first image generation module 110 such that they respectively sequentially generate test patterns TP1, TP2, TP3, and TP4.

Certain examples described herein may also be embodied in the form of a computer-readable recording medium for storing a command and data executable by a computer. At least one of the command and the data may be stored in the form of program code, and when executed by a processor, may generate a predetermined program module to perform a predetermined operation.

The computer-readable recording medium may refer to, for example, a magnetic storage medium such as a hard disk, an optical reading medium such as compact disc (CD) or digital versatile disc (DVD), etc., or may refer to a memory included in a server accessible through a network. For example, the computer-readable recording medium may be at least one of the storage unit 50 of the image forming device 1 or the control memory 32 of the controller 30, or may be a memory included in an external device connected to the image forming device 1 through a network.

While the present disclosure has been particularly shown and described with reference to exemplary examples thereof, it will be understood by those of ordinary skill in the art that various changes in form and details may be made therein without departing from the spirit and scope of the present disclosure as defined by the following claims.

The invention claimed is:

1. An image forming device comprising:

a transfer belt to move in a preset direction;

a plurality of image generators to respectively generate a toner image on the transfer belt; and a controller to output an image generation signal to each of the plurality of image generators such that each of the plurality of image generators generates a toner image, wherein the plurality of toner images generated by the plurality of image generators are arranged on the transfer belt in parallel to each other, and an arrangement order of the plurality of toner images is identical to an arrangement order of the plurality of image generators, and wherein the plurality of toner images are generated simultaneously by the plurality of image generators.

2. The image forming device of claim 1, wherein each of the plurality of toner images is partitioned into a plurality of image regions according to a concentration level.

3. The image forming device of claim 2, further comprising an optical sensor to emit light towards the transfer belt and to sense light reflected by the plurality of toner images, wherein the controller controls a concentration of the toner images generated using the plurality of image generators based on an intensity of the reflected light.

4. The image forming device of claim 1, wherein each of the plurality of toner images comprises at least one horizontal bar and at least one slash bar.

5. The image forming device of claim 4, further comprising an optical sensor to emit light towards the transfer belt and to sense light reflected by the plurality of toner images, wherein the controller aligns a plurality of toner images generated by using the plurality of image generators based on a pattern of the reflected light.

6. The image forming device of claim 1, wherein the controller simultaneously outputs the image generation signal to the plurality of image generators.

7. The image forming device of claim 6, wherein a length of a toner image generated according to the image generation signal that is simultaneously output to the plurality of image generators is equal to or less than a distance between the plurality of image generators.

8. The image forming device of claim 1, wherein each of the plurality of image generators comprises:

a photosensitive drum;

an exposure device to emit light to the photosensitive drum such that an electrostatic latent image is generated on the photosensitive drum; and a developer to develop the electrostatic latent image such that a toner image is generated on the photosensitive drum.

9. The image forming device of claim 8, wherein each of the exposure devices included in the plurality of image generators simultaneously initiates emission of light to generate an electrostatic latent image.

10. The image forming device of claim 9, wherein each of the developers included in the plurality of image generators simultaneously develops the electrostatic latent image to generate a toner image.

11. A method of controlling an image forming device comprising a plurality of image generators each generating a toner image on a transfer belt, the method comprising:

providing an image generation signal to the plurality of image generators;

generating the plurality of toner images on the transfer belt according to the image generation signal;

emitting light towards the transfer belt and sensing light reflected by the plurality of toner images; and performing, based on the sensed reflected light, at least one of concentration control of the plurality of toner images and alignment of the plurality of images, wherein the plurality of toner images are arranged on the transfer belt in parallel with each other, and an arrangement order of the plurality of toner images is identical to an arrangement order of the plurality of image generators, and wherein the plurality of toner images are generated simultaneously by the plurality of image generators.

12. The method of claim 11, wherein each of the plurality of toner images is partitioned into a plurality of image regions according to a concentration level.

13. The method of claim 11, wherein each of the plurality of toner images comprises at least one horizontal bar and at least one slash bar.

14. The method of claim 11, wherein the providing of the image generation signal to the plurality of image generators comprises simultaneously providing the image generation signal to the plurality of image generators.

* * * * *